US009839817B1

(12) United States Patent
Johnson et al.

(10) Patent No.: US 9,839,817 B1
(45) **Date of Patent: *Dec. 12, 2017**

(54) GOLF CLUB

(71) Applicant: Taylor Made Golf Company, Inc., Carlsbad, CA (US)

(72) Inventors: Matthew David Johnson, Carlsbad, CA (US); Joseph Henry Hoffman, Carlsbad, CA (US); Jason Andrew Mata, Carlsbad, CA (US); Matthew Greensmith, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 43 days.

This patent is subject to a terminal disclaimer.

(21) Appl. No.: 14/693,730

(22) Filed: Apr. 22, 2015

Related U.S. Application Data

(60) Provisional application No. 61/983,208, filed on Apr. 23, 2014.

(51) Int. Cl.
*A63B 53/04* (2015.01)
*A63B 53/06* (2015.01)

(52) U.S. Cl.
CPC .. *A63B 53/0466* (2013.01); *A63B 2053/0408* (2013.01); *A63B 2053/0433* (2013.01); *A63B 2053/0437* (2013.01); *A63B 2053/0458* (2013.01); *A63B 2053/0491* (2013.01)

(58) Field of Classification Search
CPC ..... A63B 53/0466; A63B 2053/0408; A63B 2053/0437; A63B 2053/0433; A63B 2053/0491; A63B 2053/0458; A63B 2053/021–2053/028
USPC ..... 473/324–350, 287–292
See application file for complete search history.

(56) References Cited

U.S. PATENT DOCUMENTS 4,077,633 A * 3/1978 Studen ..... A63B 53/0487 473/251
D257,873 S * 1/1981 MacDougall ..... D21/745
5,092,599 A * 3/1992 Okumoto ..... A63B 53/04 473/327
5,193,810 A * 3/1993 Antonious ..... A63B 53/04 473/327
5,221,086 A * 6/1993 Antonious ..... A63B 53/04 473/327
D338,935 S * 8/1993 Antonious ..... D21/733
D366,682 S * 1/1996 Antonious ..... D21/752
5,511,786 A * 4/1996 Antonious ..... A63B 53/04 473/327
D375,130 S * 10/1996 Hlinka ..... D21/752
5,632,695 A * 5/1997 Hlinka ..... A63B 53/02 473/305
6,254,494 B1 * 7/2001 Hasebe ..... A63B 53/04 473/345
D473,604 S * 4/2003 Antonious ..... D21/733
D481,087 S * 10/2003 Antonious ..... D21/733
6,773,360 B2 8/2004 Willett et al.
7,166,040 B2 1/2007 Hoffman et al.
(Continued)

*Primary Examiner* — Sebastiano Passaniti
(74) *Attorney, Agent, or Firm* — Klarquist Sparkman, LLP

(57) ABSTRACT

A golf club head includes a golf club body including a sole, a crown connected to the sole by a skirt, and a hosel connected to at least one other feature of the golf club body; a face connected to the a front end of the golf club body; and features allowing striking of a golf ball above the ideal strike location.

18 Claims, 15 Drawing Sheets

(56) References Cited

U.S. PATENT DOCUMENTS

| | | | | |
|---|---|---|---|---|
| 7,351,163 | B2 * | 4/2008 | Shimazaki | A63B 53/0466 473/345 |
| 7,455,600 | B2 * | 11/2008 | Imamoto | A63B 53/0466 473/335 |
| 7,699,717 | B2 * | 4/2010 | Morris | A63B 53/02 473/288 |
| 7,731,603 | B2 | 6/2010 | Beach et al. | |
| 7,887,431 | B2 | 2/2011 | Beach et al. | |
| 8,235,844 | B2 | 8/2012 | Albertsen et al. | |
| 8,801,541 | B2 | 8/2014 | Beach et al. | |
| 8,900,069 | B2 | 12/2014 | Beach et al. | |
| 9,079,079 | B2 * | 7/2015 | Fossum | A63B 53/0466 |
| 2002/0119828 | A1 * | 8/2002 | Toulon | A63B 53/00 473/287 |
| 2003/0125127 | A1 * | 7/2003 | Nakahara | A63B 53/04 473/329 |
| 2003/0220154 | A1 * | 11/2003 | Anelli | A63B 53/0466 473/327 |
| 2005/0009622 | A1 * | 1/2005 | Antonious | A63B 53/0466 473/327 |
| 2014/0274457 | A1 | 9/2014 | Beach et al. | |
| 2015/0148149 | A1 | 5/2015 | Beach et al. | |

* cited by examiner

GOLF CLUB

CROSS REFERENCE TO RELATED APPLICATION

This application claims the benefit of U.S. Provisional Patent Application No. 61/983,208, entitled "GOLF CLUB," filed Apr. 23, 2014, which is incorporated by reference herein in its entirety. This application incorporates by reference the following United States Patents and United States Patent Application: U.S. Patent Application No. 62/027,692, filed on Jul. 22, 2014, and entitled "GOLF CLUB," which is incorporated by reference herein in its entirety. This application references Application for U.S. patent Ser. No. 13/839,727, entitled "GOLF CLUB WITH COEFFICIENT OF RESTITUTION FEATURE," filed Mar. 15, 2013, which is incorporated by reference herein in its entirety and with specific reference to discussion of center of gravity location and the resulting effects on club performance. This application also references U.S. Pat. No. 7,731,603, entitled "GOLF CLUB HEAD," filed Sep. 27, 2007, which is incorporated by reference herein in its entirety and with specific reference to discussion of moment of inertia. This application also references U.S. Pat. No. 7,887,431, entitled "GOLF CLUB," filed Dec. 30, 2008, which is incorporated by reference herein in its entirety and with specific reference to discussion of adjustable loft and lie technology described therein and with reference to removable shaft technology and hosel sleeve connection systems. This application also references Application for U.S. patent Ser. No. 14/144,105, entitled "GOLF CLUB," filed Dec. 30, 2013, which is incorporated by reference herein in its entirety and with specific reference to discussion of moment of inertia, center of gravity placement, and the effect of center of gravity placement on mechanics of golf club heads. This Application also references Application for U.S. patent Ser. No. 12/813,442, entitled "GOLF CLUB," filed Jun. 10, 2010, which is incorporated by reference herein in its entirety and with specific reference to discussion of variable face thickness. This Application references Application for U.S. patent Ser. No. 12/791,025, entitled "HOLLOW GOLF CLUB HEAD," filed Jun. 1, 2010, and Application for U.S. patent Ser. No. 13/338,197, entitled "FAIRWAY WOOD CENTER OF GRAVITY PROJECTION," filed Dec. 27, 2011, which are incorporated by reference herein in their entirety and with specific reference to slot technology and coefficient of restitution features. This Application also references U.S. Pat. No. 6,773,360, entitled "GOLF CLUB HEAD HAVING A REMOVABLE WEIGHT," filed Nov. 8, 2002, which is incorporated by reference herein in its entirety and with specific reference to discussion of removable weight. This Application also references U.S. Pat. No. 7,166,040, entitled "REMOVABLE WEIGHT AND KIT FOR GOLF CLUB HEAD," filed Feb. 23, 2004, which is a continuation-in-part of U.S. Pat. No. 6,773,360, entitled "GOLF CLUB HEAD HAVING A REMOVABLE WEIGHT," and which is incorporated by reference herein in its entirety and with specific reference to removable weight technology.

TECHNICAL FIELD

This disclosure relates to golf clubs and golf club heads. More particularly, this disclosure relates to golf club heads with shot improvement features.

BACKGROUND

In the golf industry, club design often takes into consideration many design factors, including weight, weight distribution, spin rate, coefficient of restitution, characteristic time, volume, face area, sound, materials, construction techniques, durability, and many other considerations. Historically, club designers have been faced with performance trade-offs between design features that enhance one aspect of club performance while reducing at least one other aspect of club performance. For example, lighter weight can often lead to faster club speed, which often leads to greater distance; however, clubs that are too light weight can become uncontrollable by the user. In another example, thinner club faces often lead to distance gains, but thinning faces reduces durability in manufacture. Yet another example, high-tech materials may be used in various club designs to achieve performance results, but the gains may not justify the added costs of material acquisition and processing. The challenges of engineering modern golf clubs center largely around maximizing performance benefits while minimizing design trade-offs.

SUMMARY

A golf club head includes a golf club body including a sole, a crown connected to the sole by a skirt, and a hosel connected to at least one other feature of the golf club body; a face connected to the front end of the golf club body; and features allowing striking of a golf ball above the ideal strike location.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
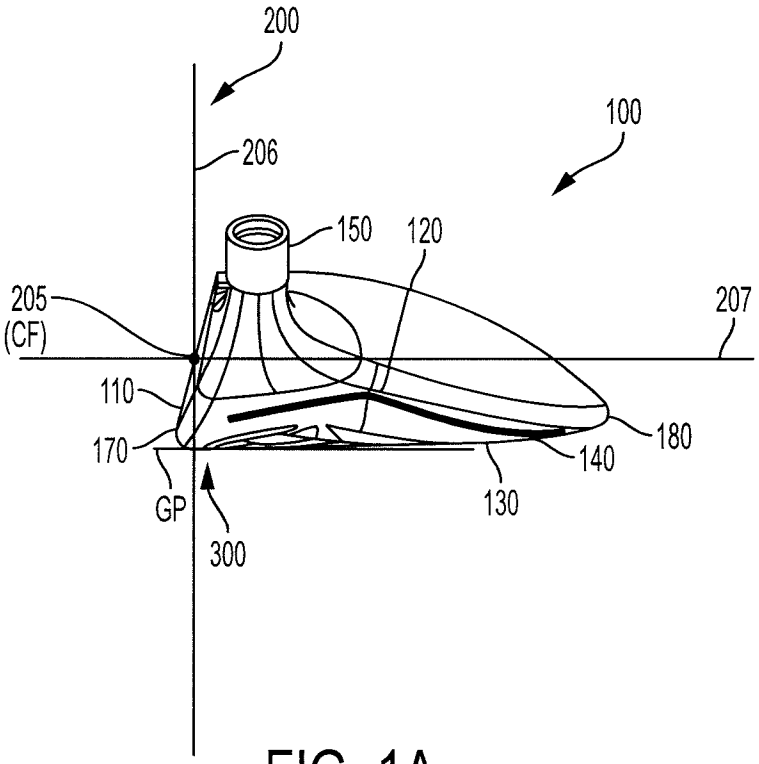
FIG. 1A is a heel side view of a golf club head in accord with one embodiment of the current disclosure.

Disclosed is a golf club including a golf club head and associated methods, systems, devices, and various apparatus. It would be understood by one of skill in the art that the disclosed golf club and golf club head are described in but a few exemplary embodiments among many. No particular terminology or description should be considered limiting on the disclosure or the scope of any claims issuing therefrom.

Modern golf club design has brought the advent of extraordinary distance gains. Just two decades ago, golf tee shots over 250 yards were considered very long shots among the longest possible—and unachievable for most amateur golfers. The advent of the metal wood head brought great possibilities to the golf industry. Just two decades later, golf technology applied to driver-type golf club heads allows many amateur golfers to achieve tee shots of greater than 300 yards. Modern golf courses have been designed longer than previously needed to address the distance gains, and many older courses have been renovated to add length in an attempt to maintain some of the difficulty of the game. The United States Golf Association (USGA) limited the Coefficient of Restitution (COR) for all golf club heads to 0.830. COR is a measure of collision efficiency. COR is the ratio of the velocity of separation to the velocity of approach. In this model, therefore, COR is determined using the following formula:

$$COR=(v_{club\text{-}post}-v_{ball\text{-}post})\div(v_{ball\text{-}pre}-v_{club\text{-}pre})$$

where, $v_{club\text{-}post}$ represents the velocity of the club after impact;

$v_{ball\text{-}post}$ represents the velocity of the ball after impact;

$v_{club\text{-}pre}$ represents the velocity of the club before impact (a value of zero for USGA COR conditions); and $v_{ball\text{-}pre}$ represents the velocity of the ball before impact.

Modern drivers achieved 0.830 COR several years ago, as the size of most drivers (reaching up to 460 cubic centimeters by USGA limit) allows engineers and designers the ability to maximize the size of the face of driver-type heads. However, fairway wood type and hybrid type golf club heads are designed with shallower heads—smaller heights as measured from the sole of the golf club head to the top of the crown of the golf club head—for several reasons. First, golfers typically prefer a smaller fairway wood type or hybrid type golf club head because the club may be used to strike a ball lying on the ground, whereas a driver-type golf club head is used primarily for a ball on a tee. When used for balls on the ground, most golfers feel it is easier to make consistent contact with a shallower golf club head than a driver-type golf club head. Second, the shallower profile of the golf club head helps keep the center of gravity of the golf club head low, which assists in lifting the ball off of the turf and producing a higher ball flight.

One drawback, however, is that the shallower height of the fairway wood type and hybrid type golf club heads often necessitates a smaller surface area of the face of the golf club head. Driver type golf club heads are able to reach the 0.830 COR limit primarily because the surface area of the face of modern driver type heads is relatively large. For fairway wood type and hybrid type golf club heads, the smaller surface area made design for distance difficult.

Relatively recent breakthroughs in golf club design—including the slot technology described in U.S. patent application Ser. No. 13/338,197, filed Dec. 27, 2011, entitled "Fairway Wood Center of Gravity Projection"—have allowed modern fairway wood type and hybrid type golf club heads to approach the 0.830 limit. Such advances have led to great distance gains for these types of clubs.

However, in addition to higher COR, it is now surprisingly understood that certain spin profile changes may occur as a result of the slot technology previously mentioned. Shots hit higher or lower on the golf club face may experience higher or lower spin rates relative to non-slotted versions of the same or similar golf club heads. Such spin variations can also affect the distance a ball travels off the golf club face. Finally, the placement of the weight in the golf club head can affect the launch angle—the angle at what the golf ball leaves the golf club head after impact—but launch angle may also be affected by the introduction of slot technology, and the placement of weight in the golf club head affects spin as well.

The result of these changes on golf club design cannot be overstated. The combination of spin, launch angle, and ball speed is determinative of many characteristics of the golf shot, including carry distance (the distance the ball flies in the air before landing), roll distance (the distance the ball continues to travel after landing), total distance (carry distance plus roll distance), and trajectory (the path the ball takes in the air), among many other characteristics of the shot.

Although distance gains were seen with the slot technology previously described, it was unclear exactly how those distance gains were achieved. Although COR was increased, the effect of the slot technology on launch angle and spin rates was not previously well understood.

For many players, the ability to hit a repeatable and consistent golf shot is paramount to scoring, even at the relatively long distances seen in fairway wood type and hybrid type golf club heads. The ability to hit a fairway wood type golf club head large distances is beneficial, but the reduction in distance for poor shots often obviates the benefit of such distance gains. As pertinent to the current disclosure, a common error amongst golfers across a variety of skill levels is mishits high on the face. Especially with respect to wood-type and hybrid-type golf club heads, poor shots struck high on the face of the golf club head contact the joint between the face and the crown, leading to so-called "sky balls," often leaving marks in the paint of the golf club head referred to as "sky marks."

Certain benefits can be seen by locating the center of gravity (CG) of the golf club head proximal to the face of the golf club head and low. It has been desirous to locate the CG low in the golf club head, particularly in fairway wood type golf clubs.

Such low and forward CG technology is described in detail with reference to U.S. patent application Ser. No. 13/839,727, filed Mar. 15, 2013, entitled "Golf Club with Coefficient of Restitution Feature," which is incorporated by reference herein in its entirety and which also described coefficient of restitution features in greater detail. In certain types of heads, it may still be the most desirable design to locate the CG of the golf club head as low as possible regardless of its location within the golf club head. However, it has unexpectedly been determined that a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads have lofts of 13 degrees or greater, and, more usually, 15 degrees or greater. In general, driver type golf club heads have lofts of 12 degrees or less, and, more usually, of 10.5 degrees or less. In general, fairway wood type golf club heads have a length from leading edge to trailing edge of 73-97 mm. Various definitions distinguish a fairway wood type golf club head form a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Driver type golf club heads of the current disclosure may be 12 degrees or less in various embodiments or 10.5 degrees or less in various embodiments.

Golf club heads of the current disclosure include features designed to allow low placement of the CG relative to impact point while including features to promote consistent impact. In various embodiments, the golf club heads of the current disclosure include much shallower profiles than prior designs while maintaining a face height to improve player confidence and reduce the likelihood of poor contact or "sky balls."

In further iterations, implementation of slot technology may allow spin reduction or increase on certain shots to address the desired flight and result. For example, a ball struck particularly low on the golf club face will generally begin its flight with a low launch angle, particularly if the golf club head includes a roll radius at the face portion. As such, it may be advantageous to provide increased spin rates for shots struck low on the golf club face to maintain carry distance. In another example, a ball struck particularly high on the golf club face will generally begin its flight with a higher launch angle. As such, it may be advantageous in some situations to provide decreased spin rates, or it may be advantageous to provide increased spin rates to prevent "flyer" shots—those that travel particularly long distances because of the inability of the golfer to spin the ball from a particular lie, such as in the rough.

Devices and systems of the current disclosure may achieve altered COR profile across the face through variable face thickness (VFT) technology while achieving greater COR and greater distance gains than prior fairway wood type and hybrid type golf club heads through the use of slot technology.

Figure 1D:
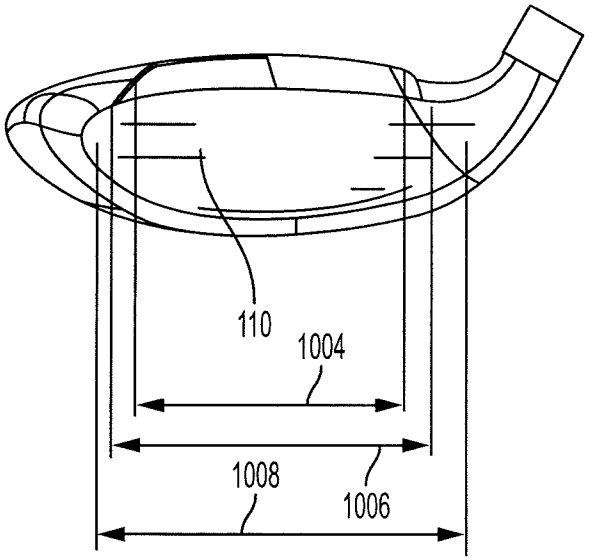
FIG. 1D is a front side view of the golf club head of FIG. 1A.
Figure 1B:
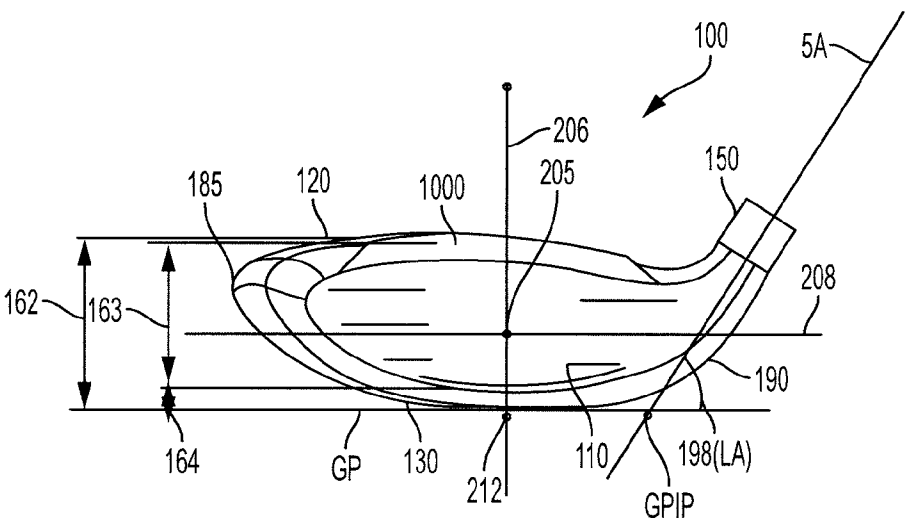
FIG. 1B is a front side view of the golf club head of FIG. 1A.
Figure 1C:
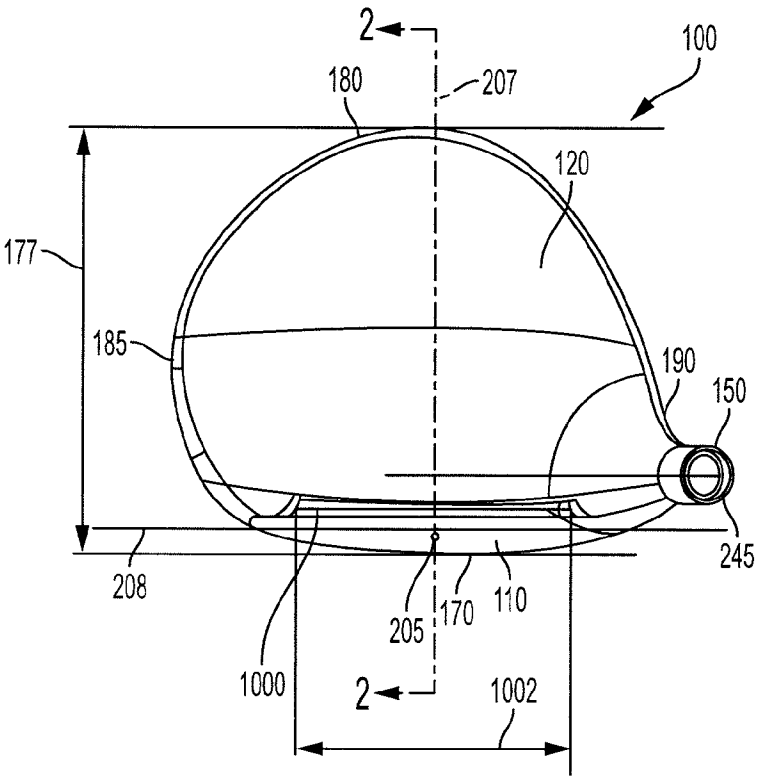
FIG. 1C is a top view of the golf club head of FIG. 1A.

One embodiment of a golf club head 100 is disclosed and described in with reference to FIGS. 1A-1C. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure. A coefficient of restitution feature (CORF) 300 is seen in the sole 130 of the golf club head 100.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

As seen with reference to FIG. 1B, the x-axis 208 is parallel to a ground plane (GP) onto which the golf club head 100 may be properly soled—arranged so that the sole 130 is in contact with the GP. The y-axis 207 (FIG. 1A) is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 (FIG. 1C) defined in the hosel 150. As such, the arrangement of the SA with respect to the golf club head 100 can define how the golf club head 100 is used. In various embodiments, an adjustable loft, lie, and face angle connection may be utilized as shown and described with reference to Application for U.S. patent Ser. No. 13/839,727, entitled "GOLF CLUB WITH COEFFICIENT OF RESTITUTION FEATURE," filed Mar. 15, 2013 and U.S. Pat. No. 7,887,431, entitled "GOLF CLUB," filed Dec. 30, 2008. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP.

The top view seen in FIG. 1C shows another view of the golf club head 100. The shaft bore 245 can be seen defined in the hosel 150. The cutting plane for FIG. 2 can also be seen in FIG. 1C. The cutting plane for FIG. 2 coincides with the y-axis 207.

Referring back to FIG. 1B, a crown height 162 is shown and measured as the height from the GP to the highest point of the crown 120 as measured parallel to the z-axis 206. In the current embodiment, the crown height 162 is about 35.2 mm. In various embodiments, the crown height 162 may be 34-40 mm. In various embodiments, the crown height may be 32-44 mm. In various embodiments, the crown height may be 30-50 mm. In various embodiments, the crown height 162 may be up to 35.2 mm.

The golf club head 100 has an effective face height 163 that is a height of the face 110 as measured parallel to the z-axis 206. The effective face height 163 measures from a highest point on the face 110 to a lowest point on the face 110 proximate the leading edge 170. In most golf club heads, a transition exists between the crown 120 and the face 110 such that the highest point on the face 110 may be slightly variant from one embodiment to another. For most golf club heads, the highest point on the face 110 and the lowest point on the face 110 are points at which the curvature of the face 110 deviates substantially from a roll radius. For some golf club heads, the deviation characterizing such point may be a 10% change in the radius of curvature.

In the current embodiment, the face height 163 includes an extended face feature (EFF) 1000. The extended face feature 1000 provides additional face area for impact with a golf ball that may occur at a heightened location on the face 110 of the golf club head 100. With the extended face feature 1000, the effective face height 163 is about 31.5 mm. In various embodiments, the effective face height 163 may be greater or less than 31.5 mm. An effective face position height 164 is a height from the GP to the lowest point on the face 110 as measured in the direction of the z-axis 206. In the current embodiment, the effective face position height 164 is about 4 mm. In various embodiments, the effective face position height 164 may be 2-6 mm. In various embodiments, the effective face position height 164 may be 0-10 mm. In various embodiments, a combination of the effective face height 163 and the effective face position height 164 may be as little as 5 mm less than the crown height 162 or as many as 5 mm greater than the crown height 162 as a result of the inclusion of the extended face feature 1000. In various embodiments, the effective face height 163 in combination with the effective face position height 164 may be about the same as the crown height 162. For the current embodiment, the combination of the effective fact position height 164 and the effective face height 163 is 35.5 mm, where the crown height is 35.2 mm. In various embodiments, the combination of effective face height 163 and effective face position height 164 may change as the crown height 162 changes. In various embodiments, the combined effective face height 163 and effective face position height 164 may be within ±10% of the crown height. In various embodiments, the EFF 1000 extends above the portion of the crown 120 that is directly adjacent to the EFF 1000. As with the current embodiment, the EFF 1000 may extend about 3 mm above the crown 120 in the region directly proximate the face 110. In various embodiments, the extension may be 2-4 mm in various embodiments, the extension may be more than 3 mm. In various embodiments, the extension may be more than 1 mm and less than 10 mm. In various embodiments, the extension may be as much as 12.5 mm. In various embodiments, the crown height 162 may be 30-40 mm. A length 177 of the golf club head 177 as measured in the direction of the y-axis 207 is seen as well with reference to FIG. 1C. In the current embodiment, the length 177 is about 67 mm. In various embodiments, the length 177 may be 60-70 mm. In various embodiments, the length 177 may be 55-73 mm. The distance 177 is a measurement of the length from the leading edge 170 to the trailing edge 180. The distance 177 may be dependent on the loft of the golf club head in various embodiments. In one embodiment, the loft of the golf club head is about 17 degrees and the distance 177 is about 67.0 mm. In one embodiment, the loft of the golf club head is about 20 degrees. In one embodiment, the loft of the golf club head is about 23 degrees. In various embodiments, the distance 177 does not change for varying lofts, although in various embodiments the distance 177 may change by 10-15 mm.

The EFF 1000 of the current embodiment is a protrusion from the joint of the crown 120 and the face 110. The extended face feature 1000 extends about tangent to the face 110 such that the hitting area of the face 110 is expanded, creating more hitting area in the direction of the positive z-axis 206. The EFF 1000 has a width 1002 as measured parallel to the x-axis 208. In the current embodiment, the width 1002 is about 60 mm, although in various embodiments the width 1002 may be larger or smaller. In various embodiments, the width 1002 is limited to the width of the face 110. In various embodiments, the width 1002 is limited to the width of the striking portion of the face. In various embodiments, the width 1002 may be 55-65 mm. In various embodiments, the width 1002 may be 52-62 mm. In various embodiments, the width 1002 may be up to 75 mm. In various embodiments, the width 1002 may be as little as 30 mm. In the current embodiment, the width 1002 is a mean width because the EFF 1000 is tapered along its ends. As seen with reference to FIG. 1D, the EFF 1000 of the current embodiment has a minimum width 1004 along its upper end of about 54 mm and a maximum width 1006 along its lower end of about 64 mm. Mean width is generally determined by averaging the minimum width 1004 and the maximum width 1006, although this may be an approximation for the width 1002. The face 110 includes a striking width 1008 parallel to the x-axis 208 of about 72 mm. As can be seen from the view of FIG. 1C, the bulge and roll profile of the EFF 1000 is about the same as that of the face 110.

Figure 2:
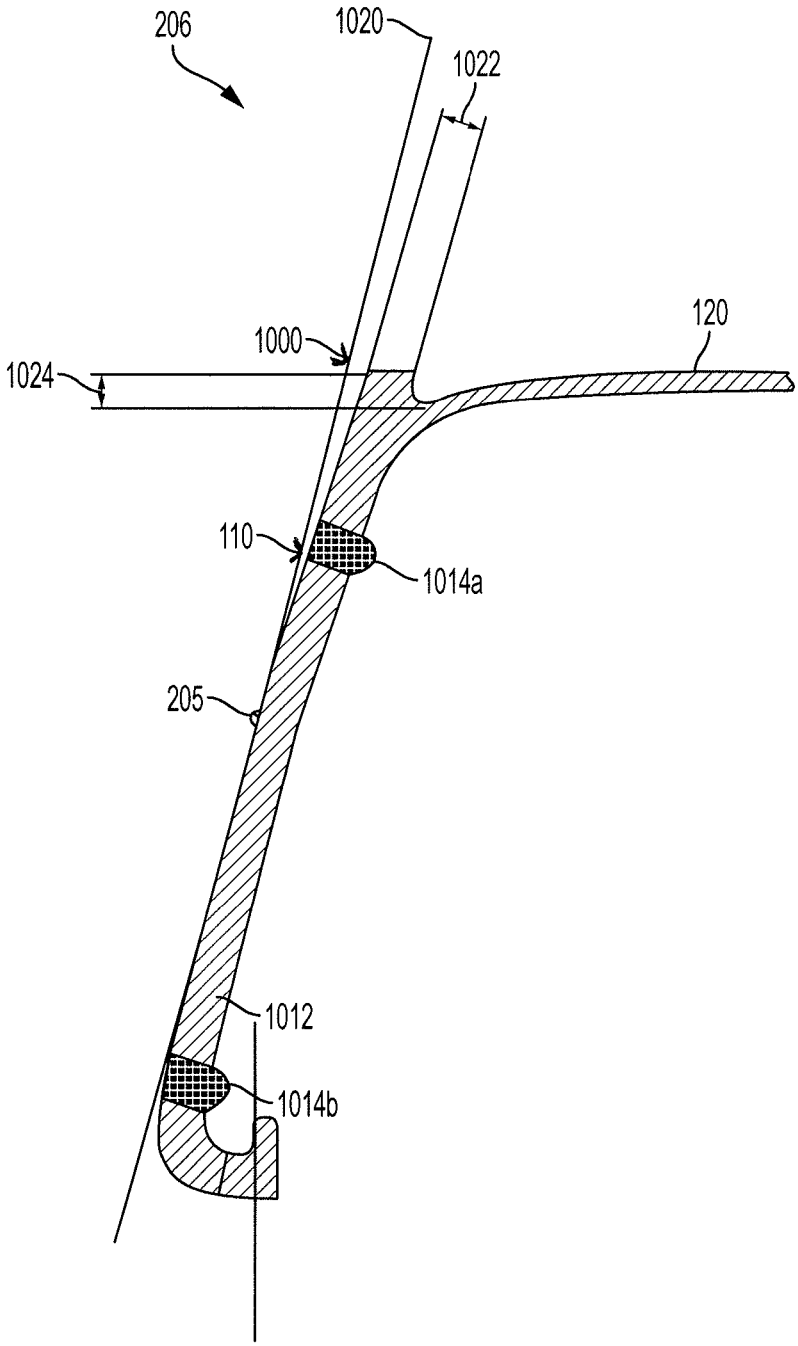
FIG. 2 is a partial detail cross-sectional view of the golf club head of FIG. 1A taken along the plane indicated by line 2-2 in FIG. 1C.

As seen with reference to FIG. 2, the EFF 1000 of the current embodiment is cast as a portion of the golf club body. However, the EFF 1000 may be formed along with a striking face insert 1012 that is welded by weld beads 1014*a,b* to the golf club body proximate the face 110. In various embodiments, the EFF 1000 may be formed in concert with portions of the face 110, portions of the body, or separately. In various embodiments, the EFF 1000 may be of the same materials as the face 110, of the body, of the face 110 and body (if they are the same), or of a different material altogether. No single construction method or material composition should be considered limiting on the scope of this disclosure. Although weld beads 1014*a,b* are seen in locations of FIG. 2, weld lines may be located along the crown 120, the sole 130, or various other locations or combinations of locations to achieve the EFF 1000, and no single arrangement of weld lines should be considered limiting on the disclosure. Additionally, in various embodiments the golf club head 100 may be made of a variety of materials, and the portion shown in FIG. 2 may be formed separately of a material sufficient for striking a golf ball while other portions may be formed of a material that would not be sufficient for striking a golf ball but would provide other advantages—including weight and cost savings, among others such as low ultimate strength composite material. In such embodiments, the body including the EFF 1000 may be formed of unitary material such that no weld bead or separate construction is necessary. In various embodiments, the EFF 1000 may be a separate element connected or secured to the golf club head 100 by secondary processing.

A tangent face plane (TFP) 1020 is seen in the view of FIG. 2. The TFP 1020 is a plane that is tangent to the face 110 at the origin 205. The EFF 1000 includes a thickness 1022 of about 2 mm as measured orthogonal to the TFP 1020. In various embodiments, the EFF 1000 may be 1.8-2.2 mm in thickness. In various embodiments, the EFF 1000 may be 1.5-2.5 mm in thickness 1022. In various embodiments, the EFF 1000 may be at least 1 mm in thickness. In various embodiments, the EFF 1000 may be at most 10 mm in thickness. In various embodiments, the EFF 1000 may be thicker or thinner than the thickness of the face 110. The EFF 1000 of the current embodiment includes a protrusion height 1024 of about 1.3 mm. The protrusion height 1024 is measured from the joint of the EFF 1000 and the crown 120 in a direction parallel to the z-axis 206. In various embodiments, the protrusion height 1024 may be 1.1-1.5 mm. In various embodiments, the protrusion height 1024 may be 0.8-2.5 mm. In various embodiments, the protrusion height 1024 may be as little at 0.5 mm. In various embodiments, the protrusion height 1024 may be at least 1 mm. In various embodiments, the protrusion height 1024 may be as great as 10 mm.

In various embodiments, the EFF 1000 and EFFs of various implementations provide increased surface area of the face 110 of the golf club head 100 without increasing the overall dimensions. As such, a golf club head in accord with the current disclosure can be made with a smaller crown height 162 as compared to golf club heads with the same effective face height 163 and the same effective face position height 164. Such an arrangement can provide a lower CG location in the golf club head 100 as compared to golf club heads with similar face size, making the golf club head 100 more effective than larger counterparts.

Additionally, the EFF 1000 provides greater visual surface area at address for the golfer, which may cause the face of the golf club head 100 to appear to be of higher loft than it measures. Such a phenomenon may lead the golfer to feel more confident with the golf club head 100 as compared to a golf club head of the same general dimensions but without the EFF 1000, as higher-lofted golf club heads tend to inspire greater confidence in golfers across a broad range of skill levels. Finally, as stated previously, the EFF 1000 provides additional hitting area for the face 110, and, as such, allows shots struck high on the face 110 to be directed more toward the golfer's target than previous designs, which would tend to direct shots more upwardly into the air. For example, the golf club head 100 includes a volume of just 149 cc as compared to a golf club head with the same face area wherein the crown abuts the top of the face 110, wherein the volume is 163 cc. In various embodiments of the current disclosure, volume of golf club head 100 may be 145-150 cc. In various embodiments of the current disclosure, volume of golf club head 100 may be 140-155 cc. In various embodiments of the current disclosure, volume of golf club head 100 may be 135-165 cc. In various embodiments of the current disclosure, volume of golf club head 100 may be up to 220 cc. In various embodiments of the current disclosure, volume of golf club head 100 may be up to 200 cc. In various embodiments of the current disclosure, volume of golf club head 100 may be greater than 120 cc.

Figure 3:
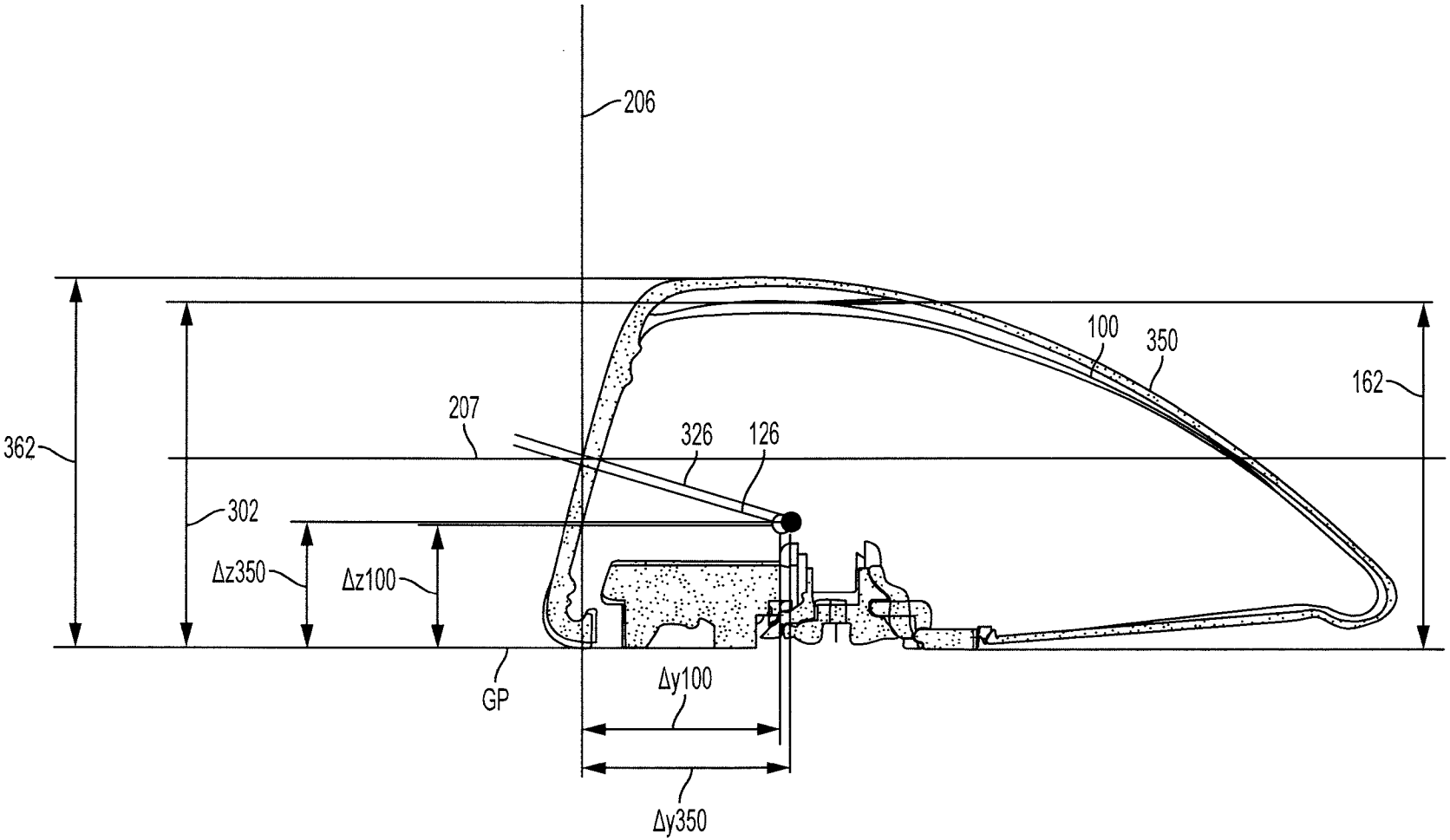
FIG. 3 is a cross-sectional view of the golf club head of FIG. 1A taken along the plane indicated by line 2-2 in FIG. 1C as compared to an exemplary golf club head.

As seen with reference to FIG. 3, a comparison of golf club head 100 with an exemplary golf club head 350 shows how the same face height 302 can be achieved with smaller crown height 162 versus a crown height 362 of the exemplary golf club head 350. In the current depiction, the face height 302 of both the golf club head 100 and the exemplary golf club head 350 are 35.2 mm. The face height 302 includes the effective face height 163 and the effective face position height 164 as discussed in prior figures. In the current embodiment, the crown height 162 is also 35.2 mm. The crown height 362 is about 37.75 mm. All dimensions of FIG. 3 are measured from the GP in a direction parallel to the z-axis 206. In various embodiments, various dimensions may be altered without deviating substantially from the technical effect of the current disclosure.

As seen with reference to FIG. 3, a vertical CG location ($\Delta_z$) can be seen for both the golf club head 100 and the exemplary golf club head 350. For the golf club head 100, a CG location $\Delta_{z100}$ is about 12.75 mm, whereas a CG location $\Delta_{z350}$ of the golf club head 350 is about 13 mm. Additionally, a y-axis CG location $\Delta_{y100}$ as measured from the origin 205 in a direction parallel to the y-axis 207 is about 11.5 mm. A y-axis CG location $\Delta_{y350}$ is also seen and is about 11.9 mm. As such, inclusion of the EFF 1000 can produce a golf club with about the same effective hitting area as a similar golf club such as exemplary golf club head 350 with a lower and more forward CG location. As such, a projection 326 of the CG of the exemplary golf club head 350 onto the face 110 is above a projection of the CG of the golf club head 100 onto the face 110. As described in, lower CG projection has multiple benefits associated therewith.

Figure 4:
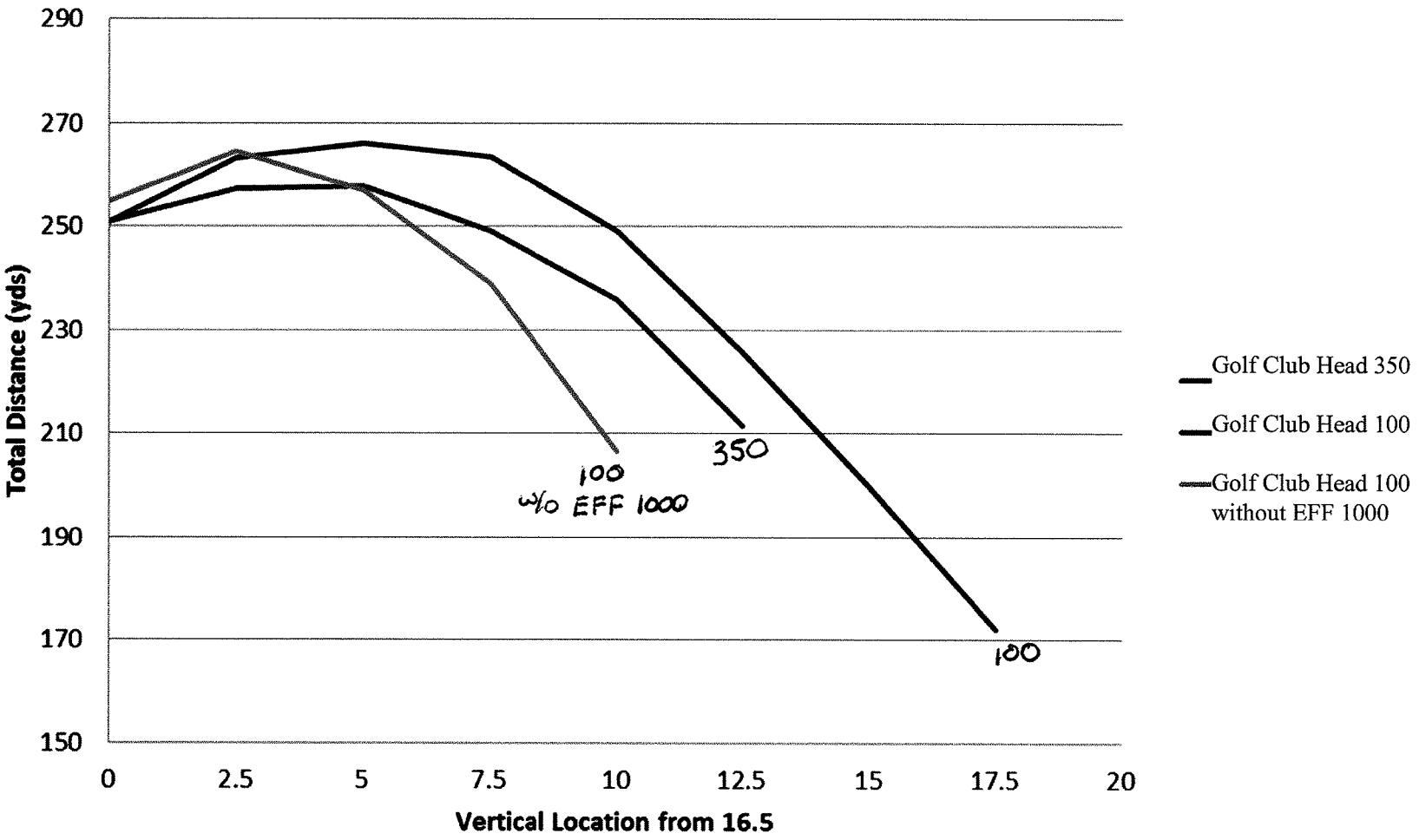
FIG. 4 is a chart comparing features of various golf club heads of the current disclosure.

A comparison of golf club head 100, golf club head 350, and a golf club head similar to golf club head 100 but without the EFF 1000 is seen in FIG. 4. Vertical location of impact is measured from a location wherein "0" for the purposes of FIG. 4 is 16.5 mm from the ground as measured in the direction of the z-axis 206 such that impact is standardized regardless of center face location. As such, a vertical striking capability can be compared regardless of the location of the center face (origin 205) with respect to the ground.

The chart of FIG. 4 includes data from robot testing of various prototypes as described. Each test was setup with a golf club as stated, each golf club having a presented loft of 16.0°, and impact conditions of 100 mph club head speed, 0° de-lofting, 0.0° path (not downward or upward at impact), 0° scoreline relative to ground (club face square to GP), and 0° face angle with respect to target (face square to target). The test utilized a robot and a head tracker to set up the club for a center face shot. The conditions with tolerances for testing are 100±1.5 mph club head speed, 0°±0.5° de-lofting, 0°±0.5° scoreline lie angle relative to ground, 0°±1° face angle relative to target line, 0°±1° inside-to-outside head path, 0°±0.5° degree downward path. Once the robot is set up to achieve these head impact conditions, the ball is placed on a tee for impact at 16.5 mm above the ground within ±0.5 mm. Ten shots are taken at the center face, and the shot conditions are measured (including carry and total distances, ball speed, spin, launch angle, and other conditions known in the art). Next, the tee is moved to another impact location (i.e., 2.5±0.5 mm upward of prior strike location), and 10 more shots are taken with the shot conditions measured. This is repeated until shot data is lost—which, in the case of the current disclosure, is indicative that the shot has been "popped up."

The robot utilized for testing is from Golf Laboratories, Inc., 2514 San Marcos Ave. San Diego, Calif. 92104. The head tracker utilized is GC2 Smart Tracker Camera System from Foresight Sports, 9965 Carroll Canyon Road, San Diego, Calif. 92131. Other robots or head tracker systems can also be used which can achieve these impact conditions. The golf ball utilized is the Taylor Made Lethal ball, but other equivalent thermoset urethane covered balls can also be used. The preferred landing surface for total distance measurement is a standard fairway condition. Also, the wind should be less than 4 mph average during the test to minimize shot to shot variability.

As can be seen, the measured distances of shot travel peaked between about 255 and 265 yards across all golf club heads. However, several advantages are notable between the various golf club heads shown in the chart of FIG. 4.

As can be seen, the distance graph for golf club head 100 is much more consistent between 2.5 mm, 5 mm, and 7.5 mm above ideal strike location (16.5 mm) than for either golf club head 350 or the golf club head without EFF 1000. Additionally, as expected, the golf club head without EFF 1000 loses data for any shots greater than 10 mm above ideal strike location, as might be expected by the lower profile golf club head. Lost data is indicative that the resultant shot was too poor to record data. As such, the chart of FIG. 4 provides an indication of the effective hitting height of the golf club heads displayed thereon, and one of skill in the art would understand that the shots for which data is lost are too poor to be considered within the statistical data set of reliability. However, surprisingly, data is lost for golf club head 350 for shots greater than 12.5 mm above ideal strike location even though data is not lost for golf club head 100 until 17.5 mm above ideal strike location. As such, FIG. 4 indicates that the EFF 1000 implemented into golf club head 100 provides even more effective hitting area than golf club head 350.

Further, as seen with reference to FIG. 4, distance as tested is about 250 yards at center face, about 265 yards at 2.5 mm above center face, about 267 yards at 5.0 mm above center face, about 265 yards at 7.5 mm above center face, and about 250 yards at 10 mm above center face. Additional distances as seen are about 225 yards at 12.5 mm above center face, about 200 yards at 15 mm above center face, and about 172 yards at 17.5 mm above center face. As such, tested distance gaps at 2.5 mm above center face, 5.0 mm above center face, and 7.5 mm above center face were not greater than 1% different in the current embodiment. Additionally, the measured yardage was about the same for a strike location at center face as for a strike location of 10 mm above center face. In some embodiments, this may be within about 2% of the center face strike.

In various embodiments, the EFF 1000 may include various cosmetic modifications or have a more blended shape to prevent visual distraction. In various embodiments, the EFF 1000 may be arranged such that it provides an additional alignment feature, giving the golfer a more clear top line than most typical wood-type golf club heads. In various embodiments, the EFF 1000 may be accentuated to provide additional contrast, such as including highlighting paint colors proximate the EFF 1000 or providing more visually appealing color combinations proximate the EFF 1000. In various embodiments, player preferences may be maximized based on the location and size of the EFF 1000. In various embodiments, various dimensions may be utilized to provide an EFF 1000 may change, and one of skill in the art would understand that golf club heads including EFFs may be embodied in a variety of methods, systems, and physical elements, and no single element or feature of the disclosure should be considered limiting on the scope of enablement herein.

FIGS. 5-9 show golf club heads that provide increased COR by increasing or enhancing the perimeter flexibility of the striking face 2018 of the golf club. For example, FIG. 5A is a side sectional view in elevation of a club head 2200*a* having a high COR. Near the face plate 2018, a channel 2212*a* is formed in the sole 2014. A mass pad 2210*a* is separated from and positioned rearward of the channel 2212*a*. The channel 2212*a* has a substantial height (or depth), e.g., at least 20% of the club head height, HCH, such as, for example, at least about 23%, or at least about 25%, or at least about 28% of the club head height HCH. In the illustrated embodiment, the height of the channel 2212*a* is about 30% of the club head height. In addition, the channel 2212*a* has a substantial dimension (or width) in the y direction.

Figures 5A, 5B, 5C, 5D, 5E:
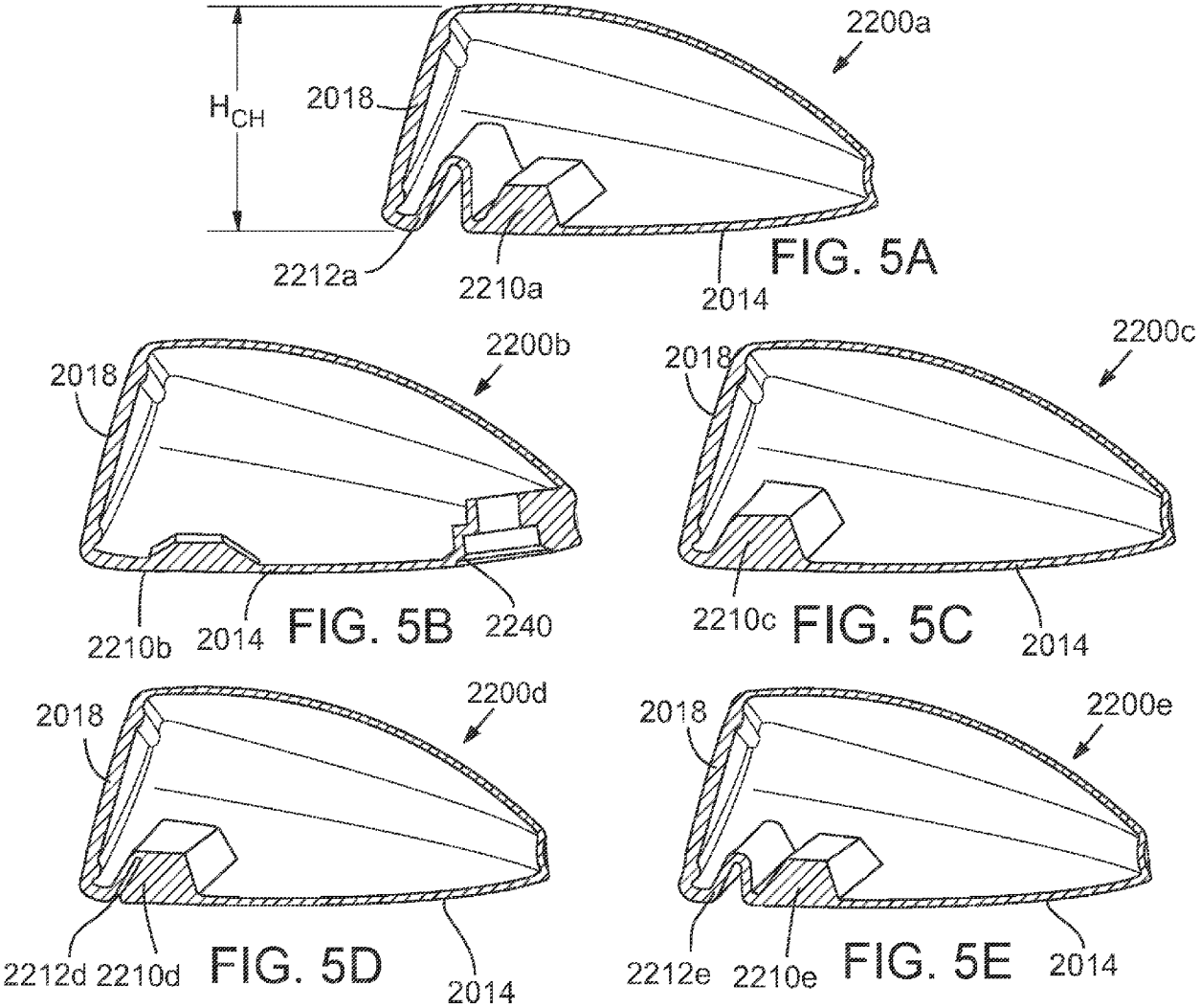
FIG. 5A is a side sectional view in elevation of a golf club head having a channel formed in the sole and a mass pad positioned rearwardly of the channel.
FIGS. 5B-E are side sectional views in elevation of golf club heads having mass pads mounted to the sole in different configurations and in some cases, a channel formed in the sole.
Figure 6A:
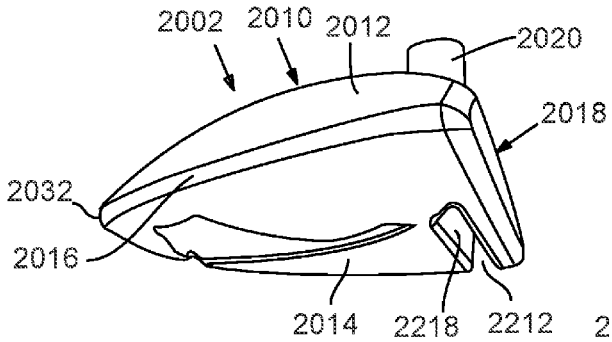
FIG. 6A is a side elevation view of another embodiment of a golf club head.
Figure 6B:
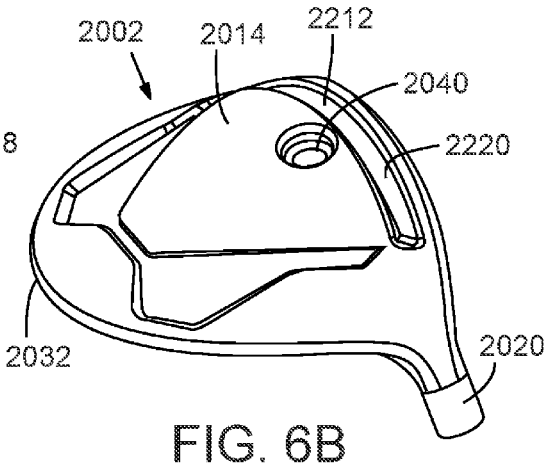
FIG. 6B is a bottom perspective view from a heel side of the golf club head of FIG. 6A.
Figure 6C:
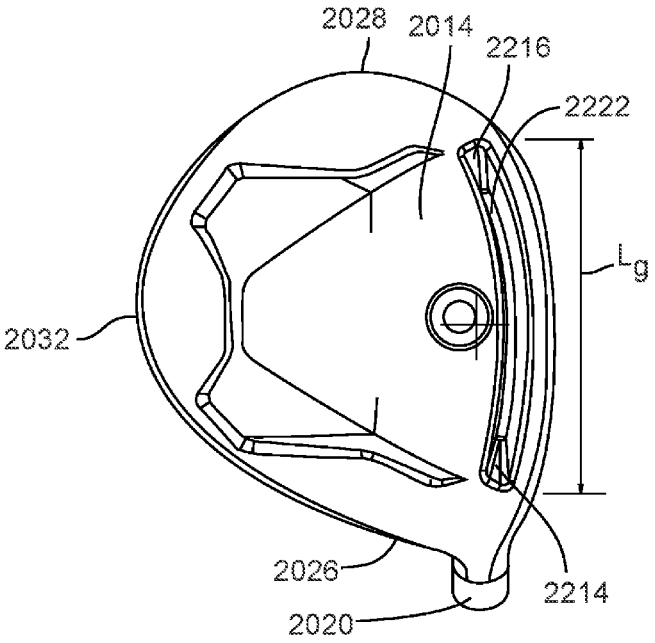
FIG. 6C is a bottom elevation view of the golf club head of FIG. 6A.
Figure 6D:
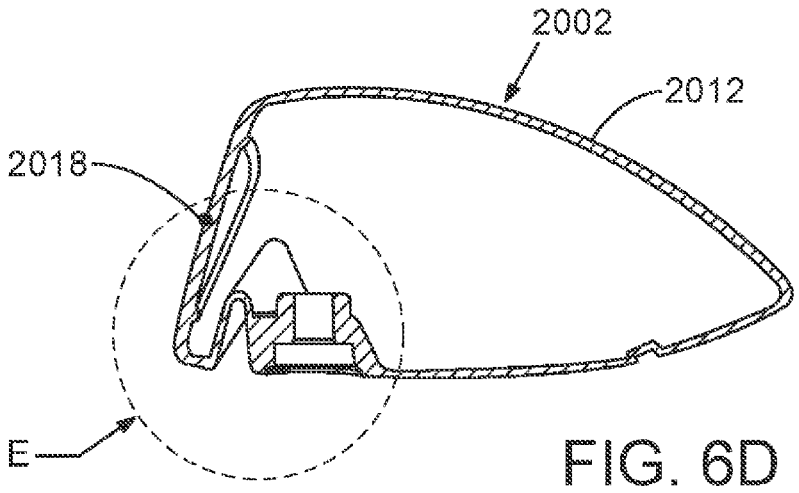
FIG. 6D is a cross-sectional view from the heel side of the golf club head of FIG. 6A showing internal features of the embodiment of FIG. 6A.
Figure 6E:
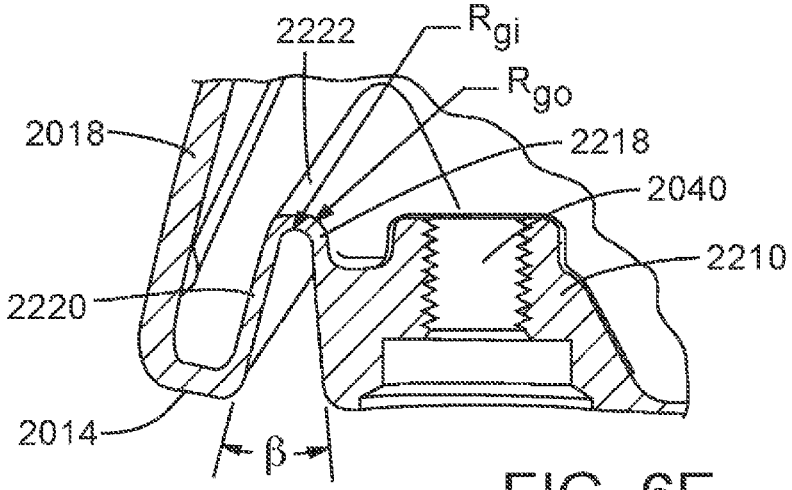
FIG. 6E is a cross-sectional view of the portion of the golf club head within the dashed circle labeled "E" in FIG. 6D.
Figure 6F:
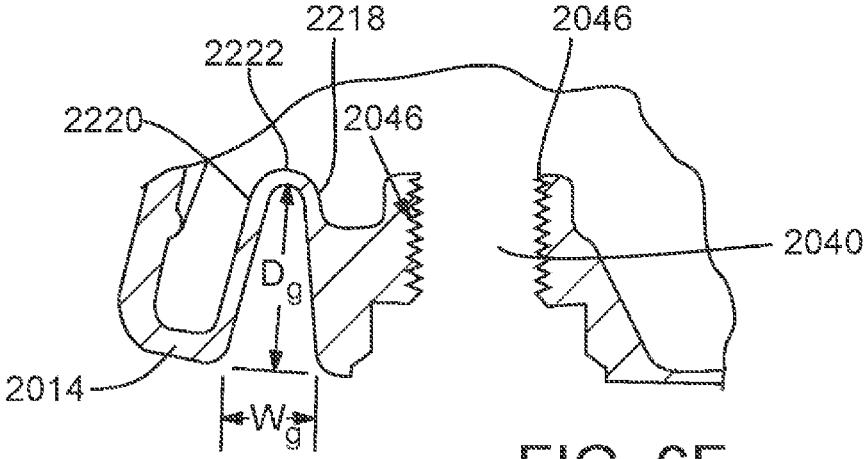
FIG. 6F is another cross-sectional view of the portion of the golf club head within the dashed circle labeled "E" in FIG. 6D.
Figure 6G:
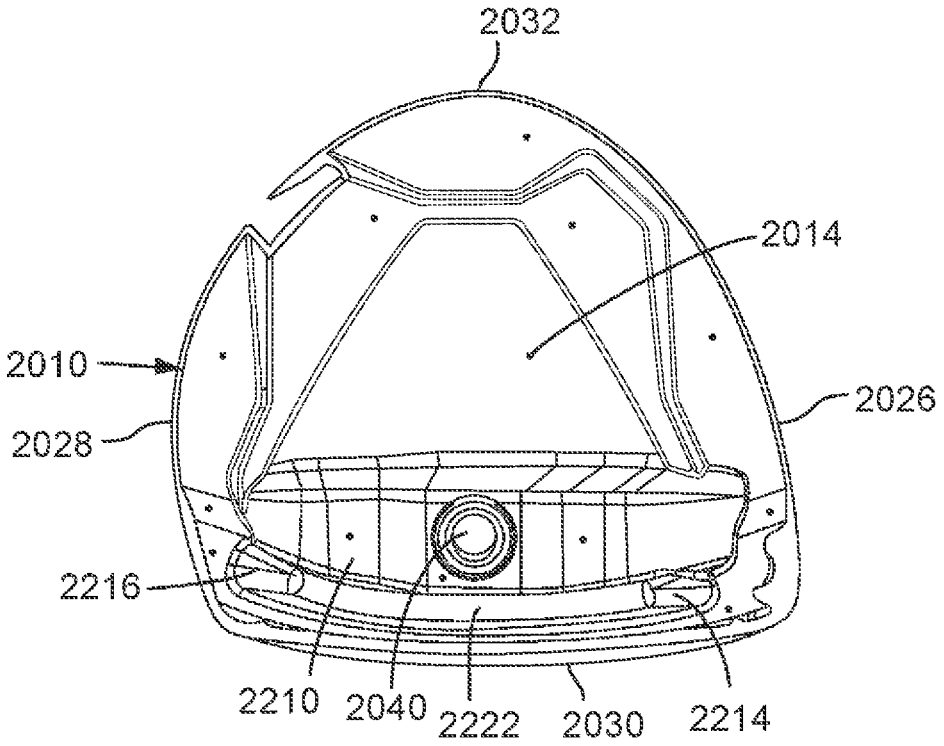
FIG. 6G is a cross-sectional view from the top of the golf club head of FIG. 6A showing internal features of the embodiment of FIG. 6A.
Figure 6H:
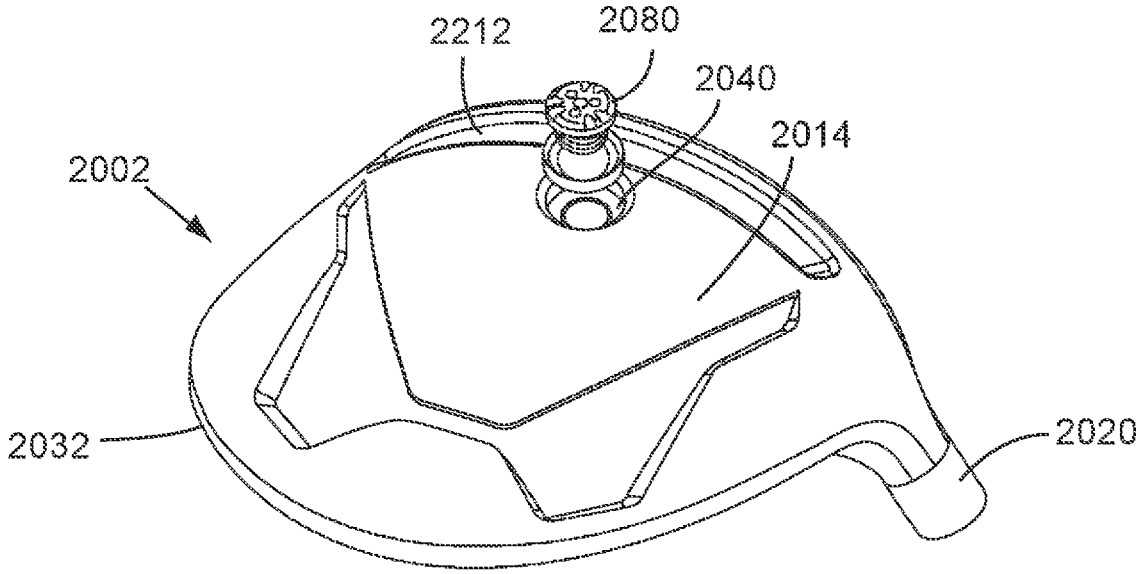
FIG. 6H is a bottom perspective view from a heel side of the golf club head of FIG. 6A, showing a weight in relation to a weight port.
Figure 7A:
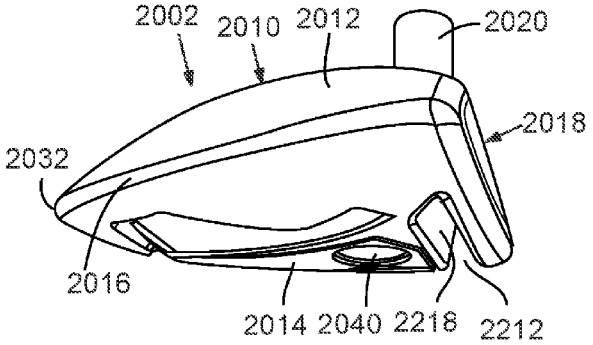
FIG. 7A is a side elevation view of another embodiment of a golf club head.
Figure 7B:
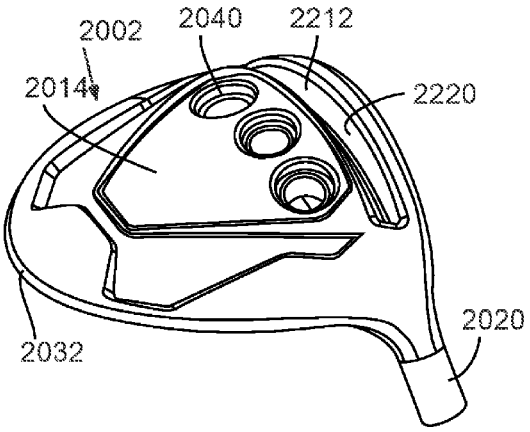
FIG. 7B is a bottom perspective view from a heel side of the golf club head of FIG. 7A.
Figure 7C:
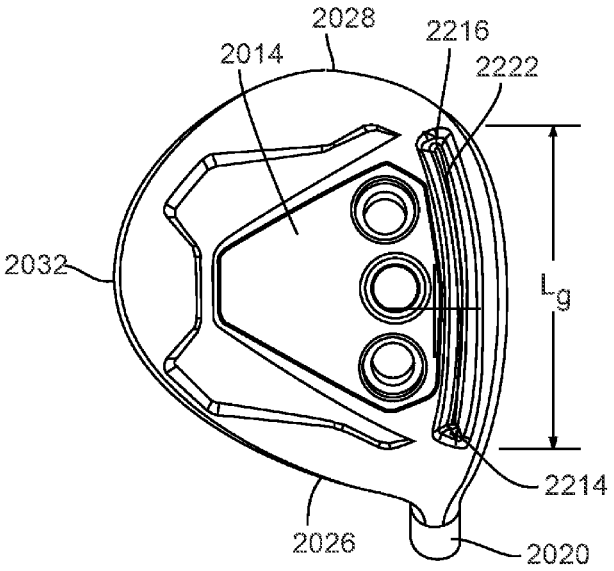
FIG. 7C is a bottom elevation view of the golf club head of FIG. 7A.
Figure 7D:
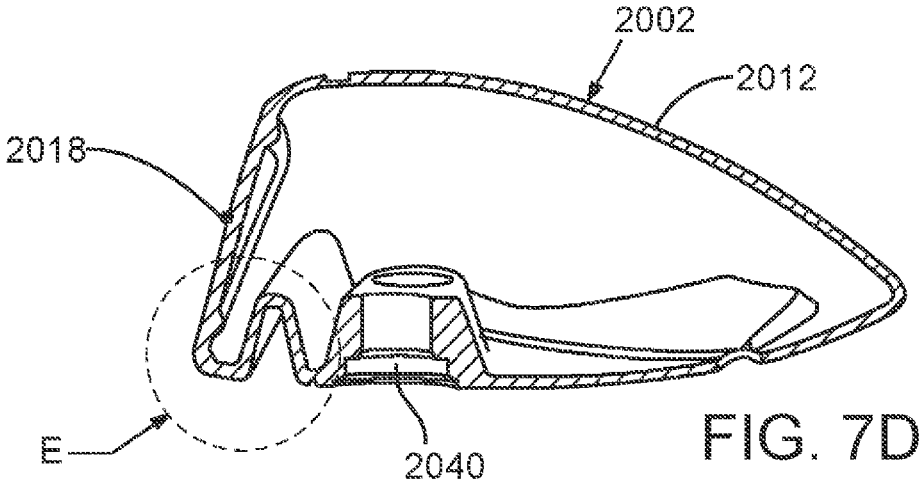
FIG. 7D is a cross-sectional view from the heel side of the golf club head of FIG. 7A showing internal features of the embodiment of FIG. 7A.
Figure 7E:
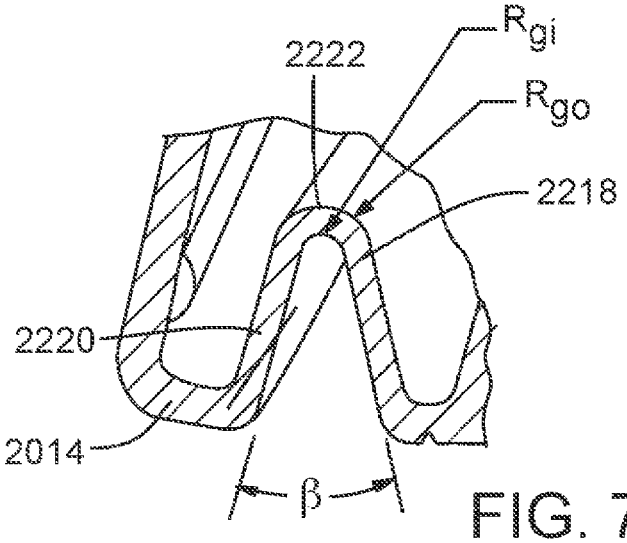
FIG. 7E is a cross-sectional view of the portion of the golf club head within the dashed circle labeled "E" in FIG. 7D.
Figure 7F:
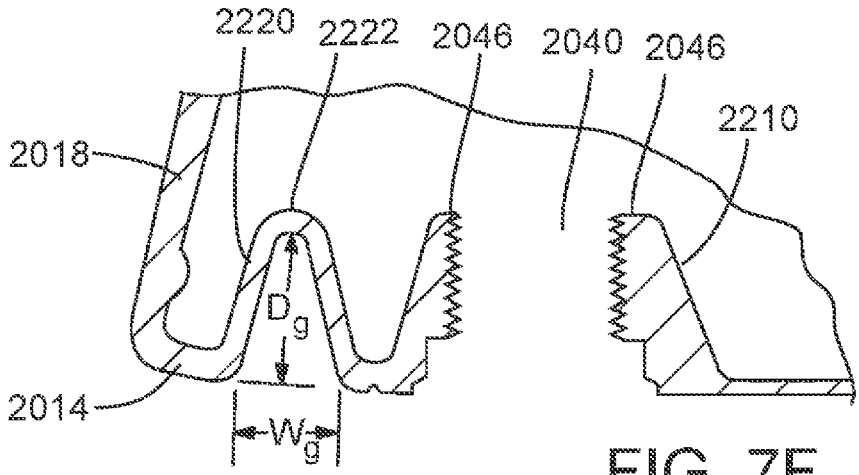
FIG. 7F is another cross-sectional view of the portion of the golf club head within the dashed circle labeled "E" in FIG. 7D.
Figure 7G:
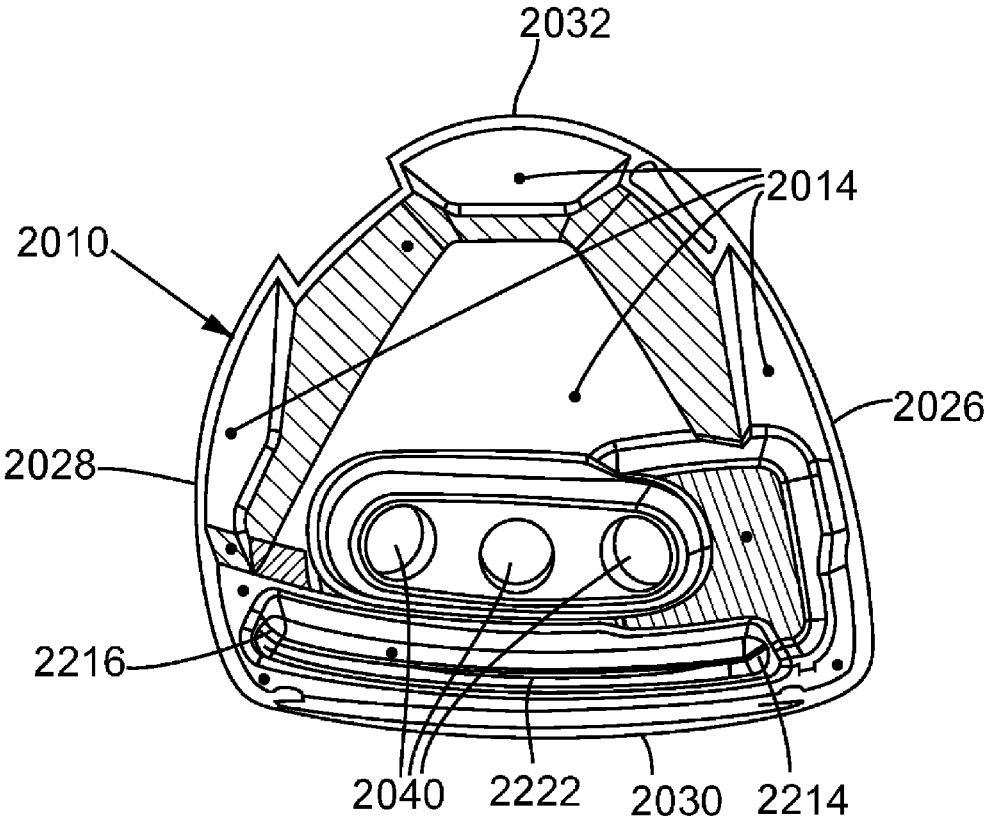
FIG. 7G is a cross-sectional view from the top of the golf club head of FIG. 7A showing internal features of the embodiment of FIG. 7A.
Figure 7H:
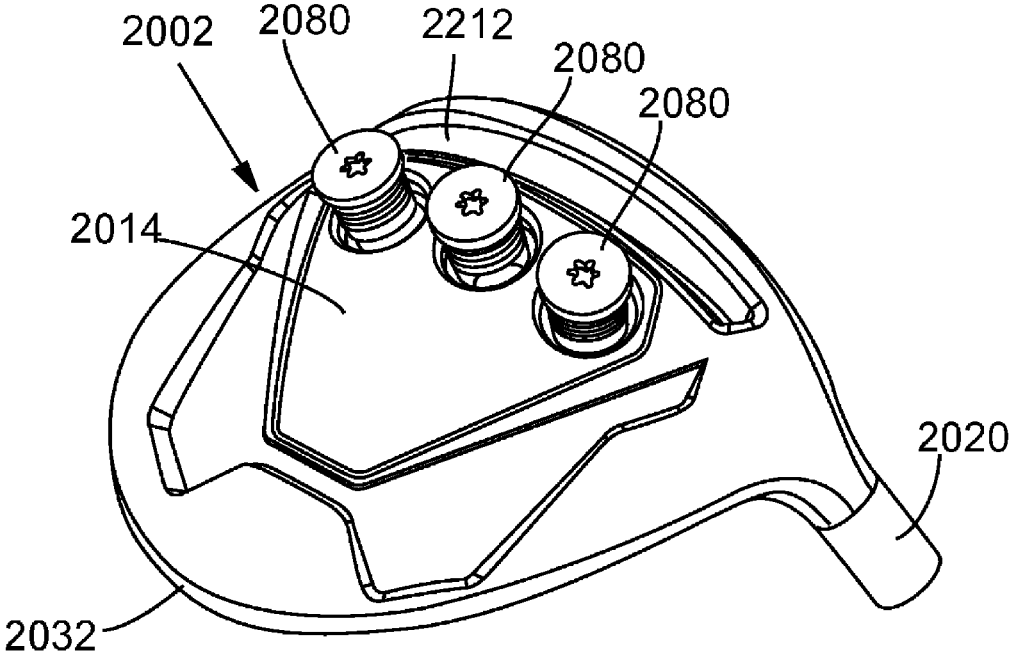
FIG. 7H is a bottom perspective view from a heel side of the golf club head of FIG. 7A, showing a plurality of weights in relation to a plurality of weight ports.

As seen in FIG. 5A, the cross section of the channel 2212*a* is a generally inverted V. In some embodiments, the mouth of the channel has a width of from about 3 mm to about 11 mm, such as about 5 mm to about 9 mm, such as about 7 mm in the Y direction (from the front to the rear) and has a length of from about 50 mm to about 110 mm, such as about 65 mm to about 95 mm, such as about 80 mm in the X direction (from the heel to the toe). The front portion of the sole in which the channel is formed may have a thickness of about 1.25-2.3 mm, for example about 1.4-1.8 mm. The configuration of the channel 2212*a* and its position near the face plate 2018 allows the face plate to undergo more deformation while striking a ball than a comparable club head without the channel 2212*a*, thereby increasing both COR and the speed of golf balls struck by the golf club head. Too much deformation, however, can detract from performance. By positioning the mass pad 2210*a* rearward of the channel 2212*a*, as shown in the embodiment shown in FIG. 5A, the deformation is localized in the area of the channel, since the club head is much stiffer in the area of the mass pad 2210*a*.

As a result, the ball speed after impact is greater for the club head 2200*a* than for a conventional club head, which results in a higher COR.

FIGS. 5B-5E are side sectional views in elevation similar to FIG. 5A and showing several additional examples of club head configurations. The illustrated golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Representative COR and stress values for the modeled golf club heads were determined and allow for a qualitative comparison among the illustrated club head configurations.

In the club head 2200*b* embodiment shown in FIG. 5B, a mass pad 2210*b* is positioned on the sole 2014 and the resulting COR is the lowest of the five club head configurations in FIGS. 5A-5E. In the club head 2200*c* embodiment shown in FIG. 5C, a mass pad 2210*c* that is larger than the mass pad 2210*b* is positioned on the sole 2014 in a more forward location in the club head than the position of the mass pad 2210*b* in the FIG. 6B embodiment. The resulting COR for the club head 2200*c* is higher than the COR for the club head 2200*b*. By moving the mass forward, the CG is also moved forward. As a result, the projection of the CG on the striking face 2018 is moved downward, i.e., it is at a lower height, for the club head 2200*c* compared to the club head 2200*b*.

In the club head 2200*d* shown in FIG. 5D, the mass pad 2210*d* is positioned forwardly, similar to the mass pad 2210*c* in the club head 2200*c* shown in FIG. 5C. A channel or gap 2212*d* is located between a forward edge of the mass pad 2210*d* and the surrounding material of the sole 2014, e.g., because of the fit in some implementations between the added mass and a channel in the sole, as is described below in greater detail. The resulting COR in the club head 2200*d* is higher than the club head 2200*b* or 2200*c*.

In the club head 2210*e* shown in FIG. 5E, the club head 2200*e* has a dedicated channel 2212*e* in the sole, similar to the channel 2212*a* in the club head 2200*a*, except shorter in height. The resulting COR in the club head 2200*d* is higher than for the club head 2200*c* but lower than for the club head 2200*a*. The maximum stress values created in the areas of the channels 2212*a* and 2212*e* while striking a golf ball for the club heads 2210*a*, 2210*e* are lower than for the club head 2200*d*, in part because the geometry of the channels 2212*a*, 2212*e* is much smoother and with fewer sharp corners than the channel 2210*d*, and because the channel 2210*d* has a different configuration (it is defined by a thinner wall on the forward side and the mass pad on the rearward side).

Additional golf club head embodiments are shown in FIGS. 6A-H, 7A-H, 8A-B, and 9A-C. Like the examples shown in FIGS. 5A-E, the illustrated golf club heads provide increased COR by increasing or enhancing the perimeter flexibility of the striking face 2018 of the golf club. For example, FIGS. 6A-H show a golf club head 2002 that includes a channel 2212 extending over a portion of the sole 2014 of the golf club head 2002 in the forward portion of the sole 2014 adjacent to or near the striking face 2018. The location, shape, and size of the channel 2212 provides an increased or enhanced flexibility to the striking face 2018, which leads to increased COR and characteristic time ("CT").

Turning to FIGS. 6A-H, an embodiment of a golf club head 2002 includes a hollow body 2010 defining a crown portion 2012, a sole portion 2014, and a skirt portion 2016. A striking face 2018 is provided on the forward-facing portion of the body 2010. The body 2010 can include a hosel 2020, which defines a hosel bore 2024 adapted to receive a golf club shaft. The body 2010 further includes a heel portion 2026, toe portion 2028, a front portion 2030, and a rear portion 2032.

The club head 2002 has a channel 2212 located in a forward position of the sole 2014, near or adjacent to the striking face 2018. The channel 2212 extends into the interior of the club head body 2010 and has an inverted "V" shape defined by a heel channel wall 2214, a toe channel wall 2216, a rear channel wall 2218, a front channel wall 2220, and an upper channel wallhe embodiment shown, the upper channel wall 2222 is semi-circular in shape, defining an inner radius Rgi and outer radius Rgo, extending between and joining the rear channel wall 2218 and front channel wall 2220. In other embodiments, the upper channel wall 2222 may be square or another shape. In still other embodiments, the rear channel wall 2218 and front channel wall 2220 simply intersect in the absence of an upper channel wall 2222.

The channel 2212 has a length Lg along its heel-to-toe orientation, a width Wg defined by the distance between the rear channel wall 2218 and the front channel wall 2220, and a depth Dg defined by the distance from the outer surface of the sole portion 3014 at the mouth of the channel 2212 to the uppermost extent of the upper channel wall 2222. In the embodiment shown, the channel has a length Lg of from about 50 mm to about 90 mm, or about 60 mm to about 80 mm. Alternatively, the length Lg of the channel can be defined relative to the width of the striking surface Wss. For example, in some embodiments, the length of the channel Lg is from about 80% to about 120%, or about 90% to about 110%, or about 100% of the width of the striking surface Wss. In the embodiment shown, the channel width Wg at the mouth of the channel can be from about 3.5 mm to about 8.0 mm, such as from about 4.5 mm to about 6.5 mm, and the channel depth Dg can be from about 10 mm to about 13 mm.

The rear channel wall 2218 and front channel wall 2220 define a channel angle β therebetween. In some embodiments, the channel angle β can be between about 10° to about 30°, such as about 13° to about 28°, or about 13° to about 22°. In some embodiments, the rear channel wall 2218 extends substantially perpendicular to the ground plane when the club head 2002 is in the normal address position, i.e., substantially parallel to the z-axis 65. In still other embodiments, the front channel wall 2220 defines a surface that is substantially parallel to the striking face 2018, i.e., the front channel wall 2220 is inclined relative to a vector normal to the ground plane (when the club head 2002 is in the normal address position) by an angle that is within about ±5° of the loft angle, such as within about ±3° of the loft angle, or within about ±1° of the loft angle.

In the embodiment shown, the heel channel wall 2214, toe channel wall 2216, rear channel wall 2218, and front channel wall 2220 each have a thickness 2221 of from about 0.7 mm to about 1.5 mm, e.g., from about 0.8 mm to about 1.3 mm, or from about 0.9 mm to about 1.1 mm. Also, in the embodiment shown, the upper channel wall outer radius Rgo is from about 1.5 mm to about 2.5 mm, e.g., from about 1.8 mm to about 2.2 mm, and the upper channel wall inner radius Rgi is from about 0.8 mm to about 1.2 mm, e.g., from about 0.9 mm to about 1.1 mm.

A weight port 2040 is located on the sole portion 2014 of the golf club head 2002, and is located adjacent to and rearward of the channel 2212. As described previously in relation to FIG. 9, the weight port 2040 can have any of a number of various configurations to receive and retain any of a number of weights or weight assemblies, such as described in U.S. Pat. Nos. 7,407,447 and 7,419,441, which are incorporated herein by reference. For example, FIGS. 6E-H show an example of a weight port 2040 that provides the capability of a weight 2080 to be removably engageable with the sole 2014. The illustrated weight port 2040 defines internal threads 1046 that correspond to external threads formed on the weight 2080. Weights and/or weight assemblies configured for weight ports in the sole can vary in mass from about 0.5 grams to about 10 grams, or from about 0.5 grams to about 20 grams. In an embodiment, the body 2010 of the golf club head shown in FIGS. 6A-H is constructed primarily of stainless steel (e.g., 304, 410, 450, or 455 stainless steel) and the golf club head 2002 includes a single weight 2080 having a mass of approximately 0.9 g. Inclusion of the weight 2080 in the weight port 2040 provides a customizable club head mass distribution, and corresponding mass moments of inertia and center-of-gravity 50 locations.

In the embodiment shown, the weight port 2040 is located adjacent to and rearward of the rear channel wall 2218. One or more mass pads may also be located in a forward position on the sole 2014 of the golf club head 2002, contiguous with both the rear channel wall 2218 and the weight port 2040, as shown. As discussed above, the configuration of the channel 2212 and its position near the face plate 2018 allows the face plate to undergo more deformation while striking a ball than a comparable club head without the channel 2212, thereby increasing both COR and the speed of golf balls struck by the golf club head. By positioning the mass pad 2210 rearward of the channel 2212, the deformation is localized in the area of the channel 2212, since the club head is much stiffer in the area of the mass pad 2210. As a result, the ball speed after impact is greater for the club head having the channel 2212 and mass pad 2210 than for a conventional club head, which results in a higher COR.

Turning next to FIGS. 7A-H, another embodiment of a golf club head 2002 includes a hollow body 2010 defining a crown portion 2012, a sole portion 2014, and a skirt portion 2016. A striking face 2018 is provided on the forward-facing portion of the body 2010. The body 2010 can include a hosel 2020, which defines a hosel bore 2024 adapted to receive a golf club shaft. The body 2010 further includes a heel portion 2026, toe portion 2028, a front portion, and a rear portion 2032.

The club head 2002 has a channel 2212 located in a forward position of the sole 2014, near or adjacent to the striking face 2018. The channel 2212 extends into the interior of the club head body 2010 and has an inverted "V" shape defined by a heel channel wall 2214, a toe channel wall 2216, a rear channel wall 2218, a front channel wall 2220, and an upper channel wall 2222. In the embodiment shown, the upper channel wall 2222 is semi-circular in shape, defining an inner radius Rgi and outer radius Rgo, extending between and joining the rear channel wall 2218 and front channel wall 2220. In other embodiments, the upper channel wall 2222 may be square or another shape. In still other embodiments, the rear channel wall 2218 and front channel wall 2220 simply intersect in the absence of an upper channel wall 2222.

The channel 2212 has a length Lg along its heel-to-toe orientation, a width Wg defined by the distance between the rear channel wall 2218 and the front channel wall 2220, and a depth Dg defined by the distance from the outer surface of the sole portion 1014 at the mouth of the channel 2212 to the uppermost extent of the upper channel wall 2222. In the embodiment shown, the channel has a length Lg of from about 50 mm to about 90 mm, or about 60 mm to about 80 mm. Alternatively, the length Lg of the channel can be defined relative to the width of the striking surface Wss. For example, in some embodiments, the length of the channel Lg is from about 80% to about 120%, or about 90% to about 110%, or about 100% of the width of the striking surface Wss. In the embodiment shown, the channel width Wg at the mouth of the channel can be from about 3.5 mm to about 8.0 mm, such as from about 4.5 mm to about 6.5 mm, and the channel depth Dg can be from about 10 mm to about 13 mm.

The rear channel wall 2218 and front channel wall 2220 define a channel angle (3 therebetween. In some embodiments, the channel angle β can be between about 10° to about 40°, such as about 16° to about 34°, or about 16° to about 30°. In some embodiments, the rear channel wall 2218 extends substantially perpendicular to the ground plane when the club head 2002 is in the normal address position, i.e., substantially parallel to the z-axis. In other embodiments, such as shown in FIGS. 7A-H, the rear channel wall 2218 is inclined toward the forward end of the club head by an angle of about 1° to about 30°, such as between about 5° to about 25°, or about 10° to about 20°. In still other embodiments, the front channel wall 2220 defines a surface that is substantially parallel to the striking face 2018, i.e., the front channel wall 2220 is inclined relative to a vector normal to the ground plane (when the club head 2002 is in the normal address position) by an angle that is within about ±5° of the loft angle, such as within about ±3° of the loft angle, or within about ±1° of the loft angle. In the embodiment shown, the heel channel wall 2214, toe channel wall 2216, rear channel wall 2218, and front channel wall 2220 each have a thickness of from about 0.7 mm to about 1.5 mm, e.g., from about 0.8 mm to about 1.3 mm, or from about 0.9 mm to about 1.1 mm. Also, in the embodiment shown, the upper channel wall outer radius Rgo is from about 1.5 mm to about 2.5 mm, e.g., from about 1.8 mm to about 2.2 mm, and the upper channel wall inner radius Rgi is from about 0.8 mm to about 1.2 mm, e.g., from about 0.9 mm to about 1.1 mm.

A plurality of weight ports 2040 three are included in the embodiment shown—are located on the sole portion 2014 of the golf club head 2002, and are located adjacent to and rearward of the channel 2212. As described previously in relation to FIG. 9, the weight ports 1040 can have any of a number of various configurations to receive and retain any of a number of weights or weight assemblies, such as described in U.S. Pat. Nos. 7,407,447 and 7,419,441, which are incorporated herein by reference. For example, FIGS. 7A-H show examples of weight ports 2040 that each provide the capability of a weight 2080 to be removably engageable with the sole 2014. The illustrated weight ports 2040 each define internal threads 2046 that correspond to external threads formed on the weights 2080. Weights and/or weight assemblies configured for weight ports in the sole can vary in mass from about 0.5 grams to about 10 grams, or from about 0.5 grams to about 20 grams. In an embodiment, the golf club head 2002 shown in FIGS. 7A-H has a body 2010 formed primarily of a titanium alloy (e.g., 3-2.5, 6-4, SP700, 15-3-3-3, 10-2-3, or other alpha/near alpha, alpha-beta, and beta/near beta titanium alloys), and includes three tungsten weights 2080 each having a density of approximately 15 g/cc and a mass of approximately 18 g. Inclusion of the weights 2080 in the weight ports 2040 provides a customizable club head mass distribution, and corresponding mass moments of inertia and center-of-gravity locations.

In the embodiment shown, the weight ports 2040 are located adjacent to and rearward of the rear channel wall 2218. The weight ports 2040 are separated from the rear channel wall 2218 by a distance of approximately 1 mm to about 5 mm, such as about 1.5 mm to about 3 mm. As discussed above, the configuration of the channel 2212 and its position near the face plate 2018 allows the face plate to undergo more deformation while striking a ball than a comparable club head without the channel 2212, thereby increasing both COR and the speed of golf balls struck by the golf club head. As a result, the ball speed after impact is greater for the club head having the channel 2212 than for a conventional club head, which results in a higher COR.

In FIGS. 8A-B and 9A-C, additional golf club head 2002 embodiments include a slot 2312 formed in the sole 2014, rather than the channel 2212 shown in FIGS. 7A-H. The slot 2312 is located in a forward position of the sole 2014, near or adjacent to the striking face 2018. For example, in some embodiments a forwardmost portion of the forward edge of the slot 2312 is located within about 20 mm from the forward edge of the sole 2014, such as within about 15 mm from the forward edge of the sole 2014, or within about 10 mm from the forward edge of the sole 2014, or within about 5 mm from the forward edge of the sole 2014, or within about 3 mm from the forward edge of the sole 2014.

In some embodiments, the slot 2312 has a substantially constant width Wg, and the slot 2312 is defined by a radius of curvature for each of the forward edge and rearward edge of the slot 2312. In some embodiments, the radius of curvature of the forward edge of the slot 2312 is substantially the same as the radius of curvature of the forward edge of the sole 2014. In other embodiments, the radius of curvature of each of the forward and rearward edges of the slot 2312 is from about 15 mm to about 90 mm, such as from about 20 mm to about 70 mm, such as from about 30 mm to about 60 mm. In still other embodiments, the slot width Wg changes at different locations along the length of the slot 2312.

The slot 2312 comprises an opening in the sole 2014 that provides access into the interior cavity of the body 2010 of the club head. As discussed above, the configuration of the slot 2312 and its position near the face plate 2018 allows the face plate to undergo more deformation while striking a ball than a comparable club head without the slot 2312, thereby increasing both COR and the speed of golf balls struck by the golf club head. In some embodiments, the slot 2312 may be covered or filled with a polymeric or other material to prevent grass, dirt, moisture, or other materials from entering the interior cavity of the body 2010 of the club head.

Figure 8A:
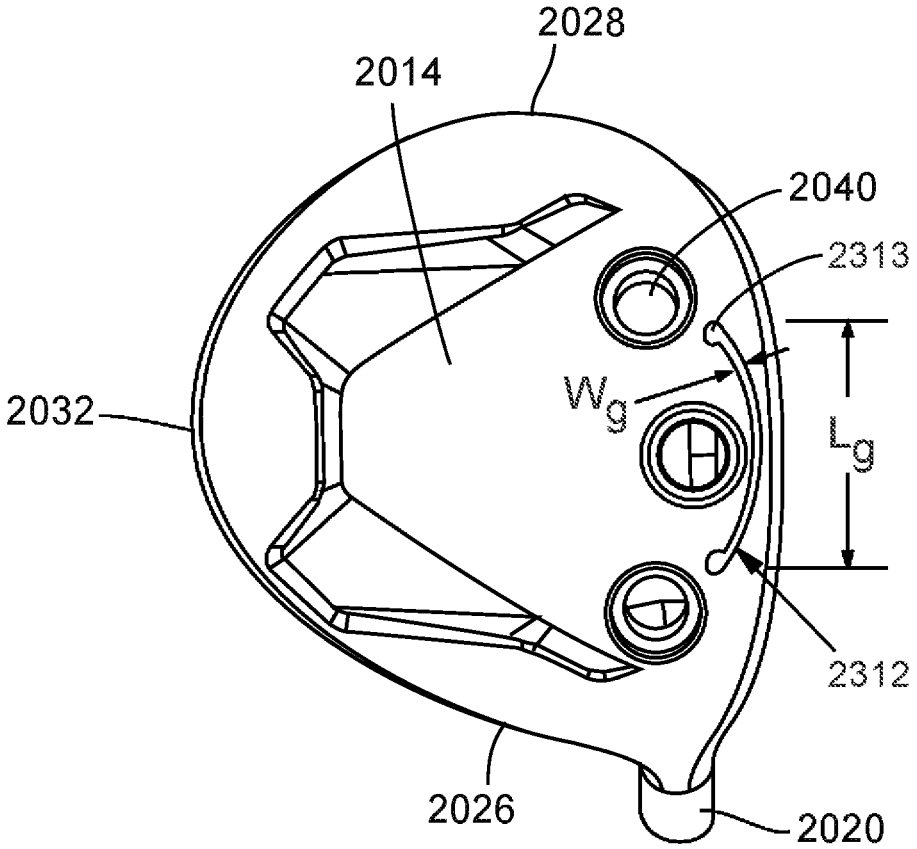
FIG. 8A is a bottom elevation view of another embodiment of a golf club head.
Figure 8B:
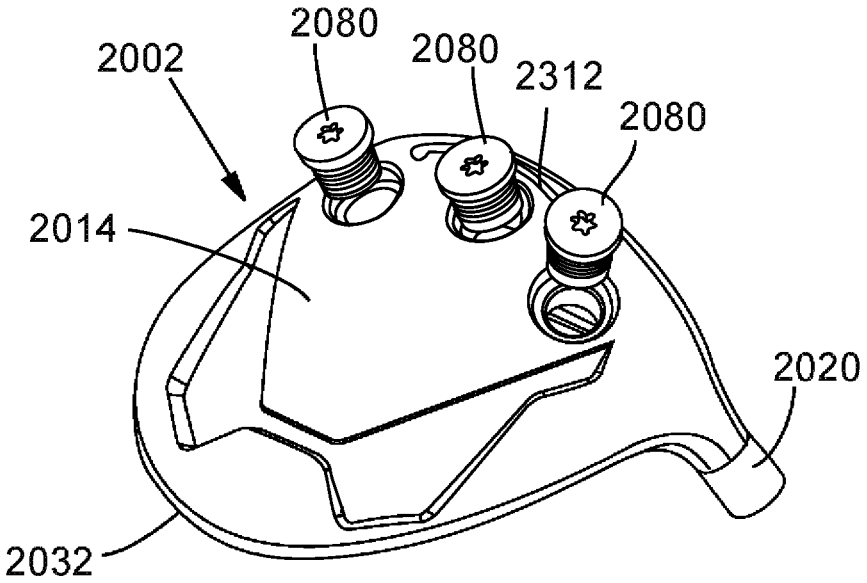
FIG. 8B is a bottom perspective view from a heel side of the golf club head of FIG. 8A, showing a plurality of weights in relation to a plurality of weight ports.

In the embodiment shown in FIGS. 8A-B, the slot 2312 includes enlarged, rounded terminal ends 2313 at both the toe and heel ends of the slot 2312. The rounded terminal ends 2313 reduce the stress incurred in the portions of the club head near the terminal ends of the slot 2312, thereby enhancing the flexibility and durability of the slot 2312.

The slot 2312 formed in the sole of the club head embodiment shown in FIGS. 8A-B has a length Lg along its heel-to-toe orientation, and a substantially constant width Wg. In some embodiments, the length Lg of the slot can range from about 25 mm to about 70 mm, such as from about 30 mm to about 60 mm, or from about 35 mm to about 50 mm. Alternatively, the length Lg of the slot can be defined relative to the width of the striking surface Wss. For example, in some embodiments, the length Lg of the slot is from about 25% to about 95% of the width of the striking surface Wss, such as from about 40% to about 70% of the width of the striking surface Wss. In the embodiment shown, the slot width Wg can be from about 1 mm to about 5 mm, such as from about 2 mm to about 4 mm. In the illustrated embodiment, the rounded terminal ends 2313 of the slot defines a diameter of from about 2 mm to about 4 mm.

In the embodiment shown in FIGS. 8A-B, the forward and rearward edges of the slot 2312 each define a radius of curvature, with each of the forward and rearward edges of the slot having a radius of curvature of about 65 mm. In the embodiment shown, the slot 2312 has a width Wg of about 1.20 mm.

A plurality of weight ports 2040 three are included in the embodiment shown—are located on the sole portion 2014 of the golf club head 2002. A center weight port is located between a toe-side weight port and a heel-side weight port and is located adjacent to and rearward of the channel 2312. As described previously in relation to FIG. 9, the weight ports 2040 can have any of a number of various configurations to receive and retain any of a number of weights or weight assemblies, such as described in U.S. Pat. Nos. 7,407,447 and 7,419,441, which are incorporated herein by reference. For example, FIGS. 8A-B show examples of weight ports 2040 that each provide the capability of a weight 2080 to be removably engageable with the sole 2014. The illustrated weight ports 2040 each define internal threads 2046 that correspond to external threads formed on the weights 2080. Weights and/or weight assemblies configured for weight ports in the sole can vary in mass from about 0.5 grams to about 10 grams, or from about 0.5 grams to about 20 grams. In an embodiment, the golf club head 2002 shown in FIGS. 8A-B has a body 2010 formed primarily of a titanium alloy (e.g., 3-2.5, 6-4, SP700, 15-3-3-3, 10-2-3, or other alpha/near alpha, alpha-beta, and beta/near beta titanium alloys), and includes three tungsten weights 2080 each having a density of approximately 15 g/cc and a mass of approximately 18 g. Inclusion of the weights 2080 in the weight ports 2040 provides a customizable club head mass distribution, and corresponding mass moments of inertia and center-of-gravity locations. In the embodiment shown, the weight ports 2040 are located adjacent to and rearward of the rear channel wall 2218. The weight ports 2040 are separated from the rear channel wall 2218 by a distance of approximately 1 mm to about 5 mm, such as about 1.5 mm to about 3 mm. As discussed above, the configuration of the channel 2212 and its position near the face plate 2018 allows the face plate to undergo more deformation while striking a ball than a comparable club head without the channel 2212, thereby increasing both COR and the speed of golf balls struck by the golf club head. As a result, the ball speed after impact is greater for the club head having the channel 2212 than for a conventional club head, which results in a higher COR.

Figure 9A:
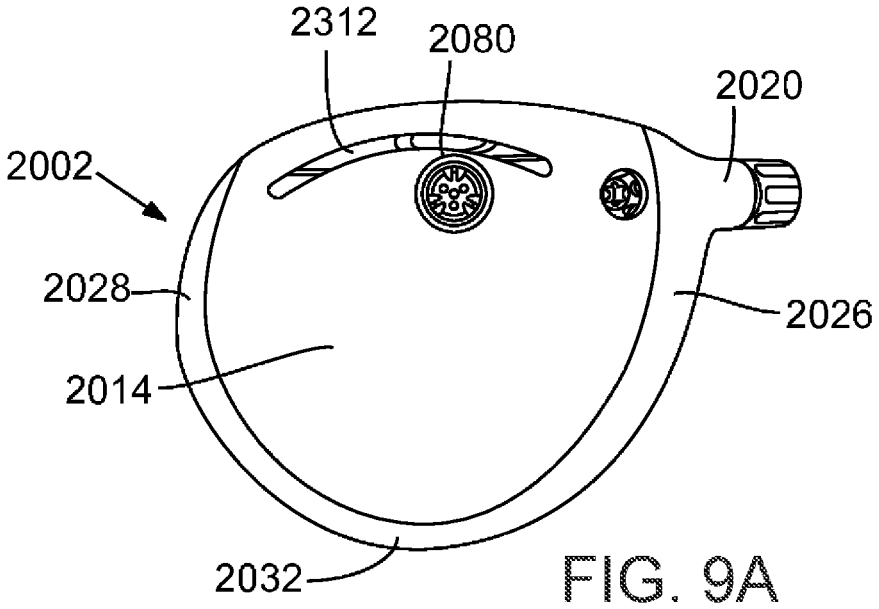
FIG. 9A is a bottom elevation view of another embodiment of a golf club head.
Figure 9B:
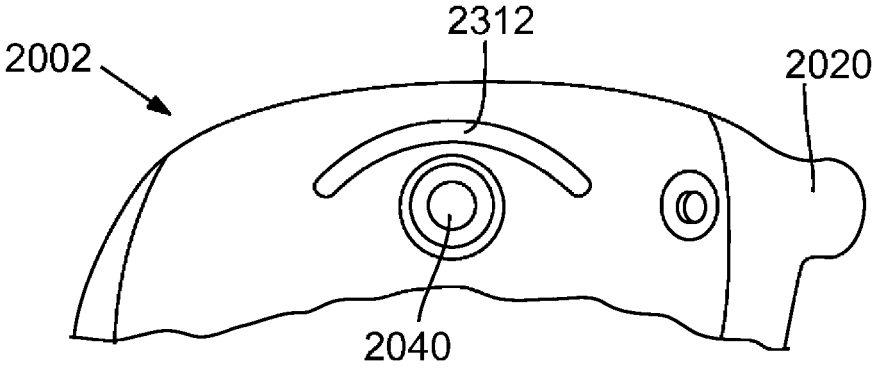
FIG. 9B is a bottom elevation view of a portion of another embodiment of a golf club head.
Figure 9C:
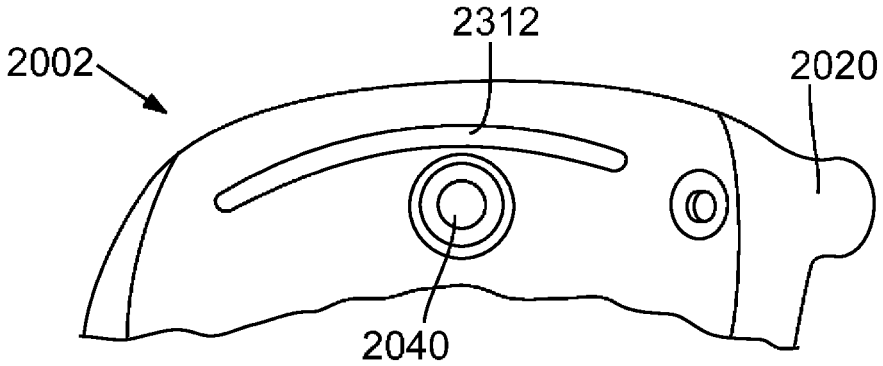
FIG. 9C is a bottom elevation view of a portion of another embodiment of a golf club head.

Three additional embodiments of golf club heads 2002 each having a slot 2312 formed on the sole 2014 near the face plate 2018 are shown in FIGS. 9A-C. Each of these additional embodiments includes a slot 2312 that does not include the enlarged, rounded terminal ends 2313 of the FIGS. 8A-B embodiments, each instead having constant width, rounded terminal ends. In the embodiment shown in FIG. 9A, the slot 2312 has a length Lg of about 56 mm, and a width Wg of about 3 mm. The forward edge of the slot 2312 is defined by a radius of curvature of about 53 mm, while the rearward edge of the slot 2312 is defined by a radius of curvature of about 50 mm. In the embodiment shown in FIG. 9B, the slot 2312 has a length Lg of about 40 mm, and a width Wg of about 3 mm. The forward edge of the slot 2312 is defined by a radius of curvature of about 27 mm, while the rearward edge of the slot 2312 is defined by a radius of curvature of about 24 mm. Finally, in the embodiment shown in FIG. 9C, the slot 2312 has a length Lg of about 60.6 mm, and a width Wg of about 3 mm. The forward edge of the slot 2312 is defined by a radius of curvature of about 69 mm, while the rearward edge of the slot 2312 is defined by a radius of curvature of about 66 mm.

Figure 10:
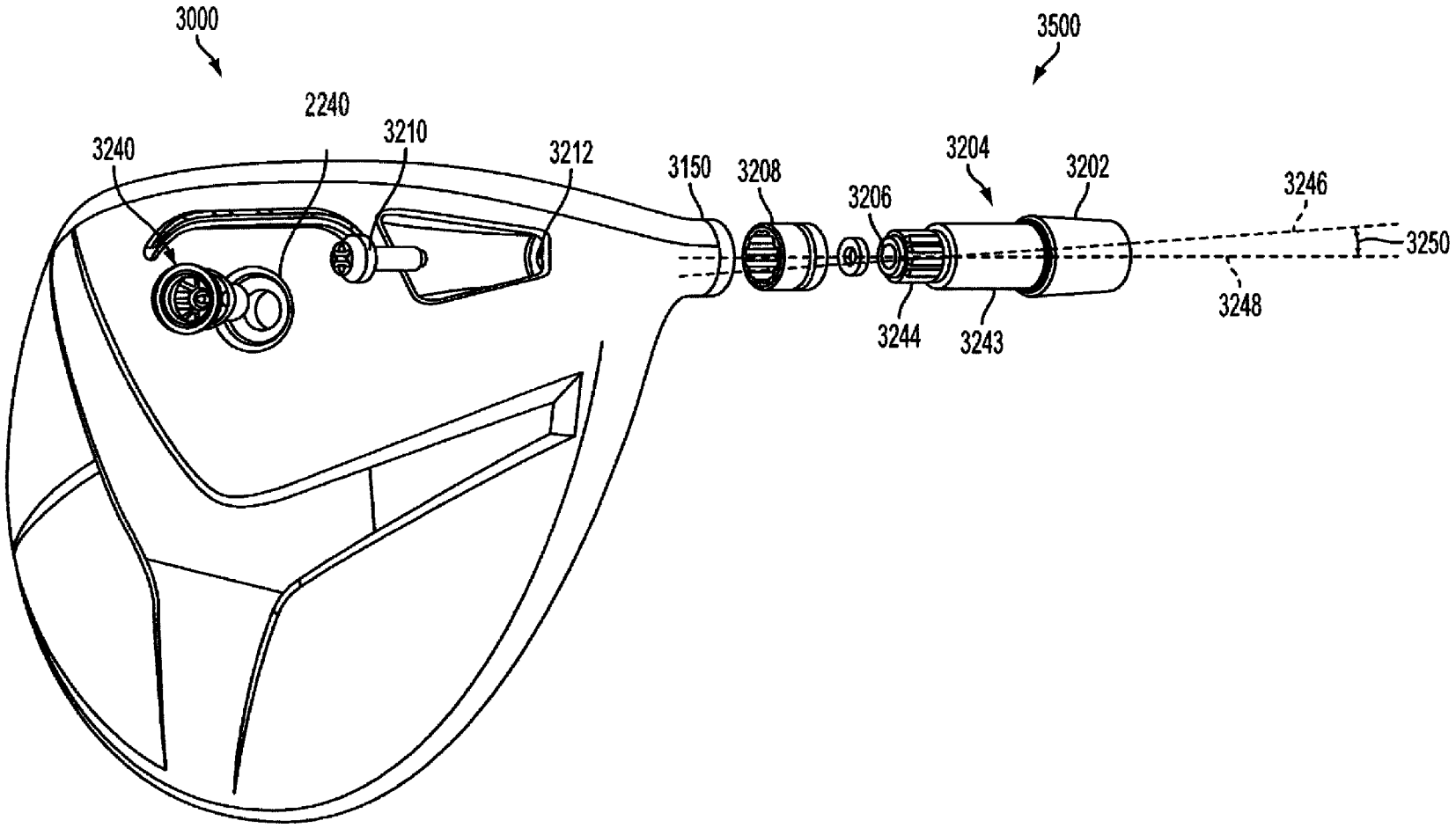
FIG. 10 is a perspective view of a golf club assembly in accord with one embodiment of the current disclosure including a golf club head in accord with one embodiment of the current disclosure.

A golf club head 3000 is shown with reference to FIG. 10. The golf club head 3000 is part of a golf club assembly 3500 that includes flight control technology. FIG. 10 illustrates a removable shaft system having a ferrule 3202 having a sleeve bore (not shown) within a sleeve 3204. A shaft (not shown) is inserted into the sleeve bore and is mechanically secured or bonded to the sleeve 3204 for assembly into a golf club. The sleeve 3204 further includes an anti-rotation portion 3244 at a distal tip of the sleeve 3204 and a threaded bore 3206 for engagement with a screw 3210 that is inserted into a sole opening 3212 defined in the club head 3000. In one embodiment, the sole opening 3212 is directly adjacent to a sole non-undercut portion. The anti-rotation portion 3244 of the sleeve 3204 engages with an anti-rotation collar 3208 which is bonded or welded within a hosel 3150 of the golf club head 3000. The adjustable loft, lie, and face angle system is described in U.S. patent application Ser. No. 12/687,003 (now U.S. Pat. No. 8,303,431), which is incorporated herein by reference in its entirety. The golf club assembly 3500 includes a weight 3240 for the weight port 2240. Although not shown, the shaft and a grip may be included as part of the golf club assembly 3500.

The embodiment shown in FIG. 10 includes an adjustable loft, lie, or face angle system that is capable of adjusting the loft, lie, or face angle either in combination with one another or independently from one another. An adjustable sole piece may be used in combination with the adjustable loft, lie and face angle system as described in detail in U.S. patent application Ser. No. 13/686,677 all of which is incorporated by reference herein it its entirety. For example, a first portion 3243 of the sleeve 3204, the sleeve bore (not shown), and the shaft collectively define a longitudinal axis 3246 of the assembly. The sleeve 3204 is effective to support the shaft along the longitudinal axis 3246, which is offset from a longitudinal axis 3248 of the by offset angle 3250. The longitudinal axis 3248 is intended to align with the SA. The sleeve 3204 can provide a single offset angle 3250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 3204 can be rotated to provide various adjustments to the golf club assembly 3500 as described in U.S. patent application Ser. No. 12/687,003 (now U.S. Pat. No. 8,303,431). One of skill in the art would understand that the system described with respect to the current golf club assembly 3500 can be implemented with various embodiments of the golf club heads of the current disclosure. One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A fairway wood type golf club head comprising:

a golf club body defining an interior cavity including a sole, a crown connected to the sole by a skirt, and a hosel connected to at least one other feature of the golf club body;

a face connected to a front end of the golf club body, the face including a center of the face defining an origin of a reference coordinate system having an x-axis being tangent to the face and parallel to a ground plane when the golf club head is positioned at address, a y-axis being orthogonal to the x-axis and parallel to the ground plane, and a z-axis being orthogonal to both the x-axis and y-axis;

an extended face feature extending from the face and defining a top end of the face, the extended face feature including a protrusion above a portion of the crown proximate the face; wherein the extended face feature expands an overall hitting area of the golf club head;

a coefficient of restitution feature (CORF) located in a forward portion of the sole proximate the face, wherein the coefficient of restitution feature is a slot;

a mass pad located on the sole within the interior cavity and positioned proximate the face in the forward portion of the sole, the mass pad being located rearward of the coefficient of restitution feature;

wherein the golf club head has a vertical CG location ($\Delta z$) positioned vertically below the origin as measured relative to the ground plane, and a y-axis CG location ($\Delta y$) positioned rearward of the coefficient of restitution feature as measured from the origin in a direction parallel to the y-axis;

wherein the extended face feature has a width as measured parallel to the x-axis ranging from 30 mm to 62 mm;

wherein the golf club head having a head length from a leading edge to a trailing edge between 73 mm and 97 mm, a crown height as measured from the ground plane in a direction parallel to the z-axis, wherein a maximum crown height of the golf club head is between 30 mm to 44 mm, a loft of 15 degrees or greater, and a volume of up to 200 cc.

2. The golf club head of claim 1, wherein at least a portion of the crown is between a highest point of the extended face feature and the point at which the maximum crown height occurs, and wherein said at least a portion of the crown is of a lower height than the highest point of the extended face feature as measured from the ground plane parallel to the z-axis;

wherein the highest point of the extended face feature is about the same as the maximum crown height as measured from the ground plane parallel to the z-axis.

3. The golf club head of claim 1, wherein the extended face feature protrudes above the portion of the crown proximate the face by a distance of at least 1 mm.

4. The golf club head of claim 1, wherein the width of the extended face feature ranges between 55-62 mm.

5. The golf club head of claim 1, wherein the width of the extended face feature is about 60 mm.

6. The golf club head of claim 1, wherein the extended face feature is a portion of the golf club body.

7. The golf club head of claim 6, wherein the extended face feature is cast with the golf club body.

8. The golf club head of claim 1, further comprising:

at least one weight port positioned proximate the face in a forward portion of the sole of the golf club head, the at least one weight port being located rearward of the coefficient of restitution feature; and at least one weight configured to be retained at least partially within the at least one weight port.

9. A fairway wood type golf club head comprising:

a golf club body defining an interior cavity including a sole, a crown connected to the sole by a skirt, and a hosel connected to at least one other feature of the golf club body;

a face connected to a front end of the golf club body, the face including a center of the face defining an origin of a reference coordinate system having an x-axis being tangent to the face and parallel to a ground plane when the golf club head is positioned at address, a y-axis being orthogonal to the x-axis and parallel to the ground plane, and a z-axis being orthogonal to both the x-axis and y-axis;

a coefficient of restitution feature (CORF) located in a forward portion of the sole proximate the face, wherein the coefficient of restitution feature is a slot;

a mass pad located on the sole within the interior cavity and positioned proximate the face in the forward portion of the sole, the mass pad being located rearward of the coefficient of restitution feature;

wherein the golf club head has a vertical CG location ($\Delta z$) positioned vertically below the origin as measured relative to the ground plane, and a y-axis CG location ($\Delta y$) positioned rearward of the coefficient of restitution feature as measured from the origin in a direction parallel to the y-axis;

wherein the golf club head having a head length from a leading edge to a trailing edge between 73 mm and 97 mm, a crown height as measured from the ground plane in a direction parallel to the z-axis, wherein a maximum crown height of the golf club head is between 30 mm to 44 mm, a loft of 15 degrees or greater, and a volume of up to 200 cc;

wherein a maximum height of the face as measured parallel to the z-axis from the ground plane is at least 90% of the maximum crown height as measured parallel to the z-axis from the ground plane;

wherein the golf club head includes an extended face feature that extends about tangent to the face and defines a top end of the face, wherein the extended face feature expands an overall hitting area of the golf club head;

wherein the extended face feature has a width as measured parallel to the x-axis ranging from 30 mm to 55 mm.

10. The golf club head of claim 9, wherein at least a portion of the crown is between a point at which the maximum height of the face occurs and the point at which the maximum crown height occurs, and wherein said at least a portion of the crown is of lower height than the maximum height of the face as measured from the ground plane parallel to the z-axis.

11. The golf club head of claim 9, wherein the extended face feature has a thickness of between 1.5-2.5 mm.

12. The golf club head of claim 9, wherein the extended face feature has a thickness of about 2 mm.

13. The golf club head of claim 9, further comprising:

at least one weight port positioned proximate the face in a forward portion of the sole of the golf club head, the at least one weight port being located rearward of the coefficient of restitution feature; and at least one weight configured to be retained at least partially within the at least one weight port.

14. A fairway wood type golf club head comprising:

a face including a toe end, a heel end, a crown end, and a sole end; and a golf club head body defined by a crown and a sole, the crown joined to the sole by a skirt, wherein the golf club head body defining an interior cavity;

the crown coupled to the crown end of the face;

the sole coupled to the sole end of the face;

a coefficient of restitution feature (CORF) located in a forward portion of the sole proximate the face, wherein the coefficient of restitution feature is a slot;

a mass pad located on the sole within the interior cavity and positioned proximate the face in the forward portion of the sole, the mass pad being located rearward of the coefficient of restitution feature;

wherein the golf club head has a vertical CG location ($\Delta z$) positioned vertically below the origin as measured relative to the ground plane, and a y-axis CG location ($\Delta y$) positioned rearward of the coefficient of restitution feature as measured from the origin in a direction parallel to the y-axis;

wherein the golf club head having a head length from a leading edge to a trailing edge between 73 mm and 97 mm, a crown height as measured from the ground plane in a direction parallel to the z-axis, wherein a maximum crown height of the golf club head is between 30 mm to 44 mm, a loft of 15 degrees or greater, and a volume of up to 200 cc;

the face including a geometric center that defines the origin of a coordinate system in which an x-axis is tangential to the face portion at a center of the face and is parallel to a ground plane when the golf club head is in a normal address position, a y-axis extending perpendicular to the x-axis and parallel to the ground plane, and a z-axis extending perpendicular to the ground plane, wherein a positive x-axis extends toward the toe end from the origin, a positive y-axis extends rearwardly from the origin, and a positive z-axis extends upwardly from the origin;

wherein the golf club head includes an extended face feature that extends about tangent to the face and defines a top end of the face, wherein the extended face feature expands an overall hitting area of the golf club head;

wherein the extended face feature has a width as measured parallel to the x-axis ranging from 30 mm to 62 mm;

wherein the face has a variable thickness.

15. The golf club head of claim 14, wherein the crown height of the golf club head is up to 35.2 mm.

16. The golf club head of claim 15, wherein the center of the face has a location as measured from the ground plane in a direction parallel to the z-axis that is not less than 16.5 mm.

17. The golf club head of claim 14, wherein an adjustable loft, lie, and face angle sleeve is coupled to the body.

18. The golf club head of claim 14, further comprising:

at least one weight port positioned proximate the face in a forward portion of the sole of the golf club head, the at least one weight port being located rearward of the coefficient of restitution feature; and at least one weight configured to be retained at least partially within the at least one weight port.

* * * * *